US011676557B2

(12) United States Patent
Park

(10) Patent No.: US 11,676,557 B2
(45) Date of Patent: Jun. 13, 2023

(54) METHOD AND DEVICE FOR SEAMLESS MODE TRANSITION BETWEEN COMMAND MODE AND VIDEO MODE

(71) Applicant: Magnachip Semiconductor, Ltd., Chungcheongbuk-do (KR)

(72) Inventor: Sangsu Park, Chungcheongbuk-do (KR)

(73) Assignee: MAGNACHIP SEMICONDUCTOR, LTD., Chungcheongbuk-Do (KR)

( * ) Notice: Subject to any disclaimer, the term of this patent is extended or adjusted under 35 U.S.C. 154(b) by 0 days.

(21) Appl. No.: 17/566,910

(22) Filed: Dec. 31, 2021

(65) Prior Publication Data

US 2022/0343877 A1 Oct. 27, 2022

(30) Foreign Application Priority Data

Apr. 23, 2021 (KR) ..... 10-2021-0053043

(51) Int. Cl.

| | |
|---|---|
| ***G09G 5/12*** | (2006.01) |
| ***G09G 5/18*** | (2006.01) |
| ***G09G 5/00*** | (2006.01) |

(52) U.S. Cl.

CPC ..... *G09G 5/12* (2013.01); *G09G 5/008* (2013.01); *G09G 5/18* (2013.01); *G09G 2330/021* (2013.01); *G09G 2360/18* (2013.01)

(58) Field of Classification Search

CPC ..... G09G 5/12; G09G 5/008; G09G 5/18; G09G 2330/021; G09G 2360/18; G09G 5/006; G09G 3/20; G06F 3/147; H04N 13/359; H04N 13/144; H04N 13/158; H04N 13/398

See application file for complete search history.

(56) References Cited

U.S. PATENT DOCUMENTS

| | | | | |
|---|---|---|---|---|
| 7,030,871 | B2 * | 4/2006 | Kitagawa | G09G 3/2092 345/98 |
| 8,878,995 | B2 | 11/2014 | Cha et al. | |
| 10,416,808 | B2 * | 9/2019 | Shekhar | G06F 3/0416 |
| 2013/0057763 | A1 * | 3/2013 | Cha | G09G 5/12 348/554 |
| 2016/0217763 | A1 * | 7/2016 | Toyoda | G09G 3/3674 |

* cited by examiner

*Primary Examiner* — Brent D Castiaux
(74) *Attorney, Agent, or Firm* — Polsinelli PC

(57) ABSTRACT

A method of seamlessly switching over between the command mode and the video mode includes receiving a command for switching over from the command mode to the video mode; generating a sampling value by measuring a time interval between a point in time of an internal synchronization signal used in the command mode and a point in time of an external synchronization signal received in the video mode; generating a parameter for shifting the internal synchronization signal based on the sampling value; shifting the internal synchronization signal to synchronize with the external synchronization signal based on the parameter; and switching over from the command mode to the video mode when the internal synchronization signal of the command mode synchronizes with the external synchronization signal. According to the disclosure, while driving a display.

20 Claims, 17 Drawing Sheets

METHOD AND DEVICE FOR SEAMLESS MODE TRANSITION BETWEEN COMMAND MODE AND VIDEO MODE

CROSS-REFERENCE TO RELATED APPLICATION

This application claims the priority of Korean Patent Application No. 10-2021-0053043 filed on Apr. 23, 2021, which is hereby incorporated by reference in its entirety.

BACKGROUND

Field of the Disclosure

The present disclosure relates to a method and device for seamless mode transition between a command mode and a video mode, and more particularly to a method and device for switching over between a command mode and a video mode without screen flickering while driving a display.

Description of the Background

Conventionally, a video is generally driven at a frame frequency of 60 Hz, but has been required to be driven at higher frame frequencies such as 90 Hz, 120 Hz, etc. in order to implement virtual reality (VR), augmented reality (AR), etc. more realistically. In this case, power is consumed because reading/writing accesses to a frame memory are continuously made in driving the video.

Both video and command modes comply with display standards. In the command mode, a synchronization signal needed for driving a display panel is generated based on an internal synchronization signal generated by a built-in internal oscillator of a display driver integrated-circuit (DDI). In the video mode, the synchronization signal is generated based on an external synchronization signal of a synchronization packet from a host.

In this process, it would be difficult to get a seamless transition between the command mode and the video mode while driving a display because clock sources for the internal synchronization signal and the external synchronization signal are different from each other and thus asynchronous, and the synchronization signals for the two modes can occur at different times due to restrictions on the host's processor and equipment. Accordingly, methods of switching over between the modes without screen flickering while driving the display need to be proposed.

There have been proposed methods of switching over between the modes without screen flickering while driving a display. One method is using a vertical/horizontal counter to have a count value for a period in a video mode and storing the last video frame in memory, and then generating an internal synchronization signal based on the count value for a vertical/horizontal period. Another method is maintaining a current frame until the current frame is completed in a command mode, and waiting for an external vertical synchronization signal to be input in a video mode. Yet another method is using logic in a host to receive an adjusted tearing effect (TE) signal and error information, and adjusting a point in time of transmitting a synchronous packet, etc.

Nonetheless, such methods cannot prevent the flicker phenomenon when a delay or latency occurs due to restrictions on the host's processor or equipment.

SUMMARY

Accordingly, the present disclosure is directed to a method and device for seamless mode transition between a command mode and a video mode that substantially obviates one or more of problems due to limitations and disadvantages described above.

More specifically, the present disclosure is to provide a dynamic synchronization method of gradually shifting a point in time of an internal synchronization signal generated by an internal oscillator of a display driver integrated-circuit (DDI) to be synchronized with a point in time of an external synchronization signal received from a host through a horizontal front porch (HFP) control method and a fine-tuning control method by which the points in times of the internal synchronization signal and the external synchronization signal that are asynchronous are synchronized with each other, and a device for performing the same.

The problems to be solved in the disclosure are not limited to those mentioned above, and other problems not mentioned may be clearly understood by a person having ordinary skill in the art, to which the disclosure pertains, from the following descriptions.

According to the present disclosure of the disclosure, a method of seamlessly switching over between a command mode and a video mode may include: receiving a command for switching over from the command mode to the video mode; generating a sampling value by measuring a time interval between a point in time of an internal synchronization signal used in the command mode and a point in time of an external synchronization signal received in the video mode; generating a parameter for shifting the internal synchronization signal based on the sampling value; shifting the internal synchronization signal to synchronize with the external synchronization signal based on the parameter; and switching over from the command mode to the video mode when the internal synchronization signal of the command mode synchronizes with the external synchronization signal.

According to the present disclosure of the disclosure, the generating the sampling value may include: obtaining a first sampling value which indicates a number of clocks from the point in time of the internal synchronization signal to the point in time of the external synchronization signal; obtaining a second sampling value which indicates a number of clocks from the point in time of the external synchronization signal to the point in time of the internal synchronization signal; and selecting a smaller value between the first sampling value and the second sampling value.

According to the present disclosure of the disclosure, the generating the parameter for shifting the internal synchronization signal based on the sampling value may include: generating a quotient and a remainder which are obtained by dividing the sampling value by a total number of lines of a display panel; setting the quotient as a horizontal front porch (HFP) adjustment amount; and generating a fine-tuning (FT) adjustment amount by multiplying the remainder by an adjustment parameter and dividing the product of multiplication by the total number of lines.

According to the present disclosure of the disclosure, the shifting the internal synchronization signal to synchronize with the external synchronization signal based on the parameter may include: identifying whether the internal synchronization signal and the external synchronization signal are synchronized; and when it is identified that the internal synchronization signal and the external synchronization signal are not synchronized, performing at least one of an HFP control operation, in which the internal synchronization signal is shifted by modifying an HFP (a waiting time after outputting valid data for a horizontal section) size with regard to all the horizontal sections in one frame based on the HFP adjustment amount, and a fine-tuning control operation, in which the internal synchronization signal is shifted by tuning a horizontal-section end point value (H end point value) with regard to a horizontal section in which an overflow occurs as an accumulated value obtained by accumulating the FT adjustment amount in every horizontal section is greater than the adjustment parameter.

According to the present disclosure of the disclosure, the fine-tuning control operation may be performed when the remainder is not 0, and the HFP control operation may be performed when the HFP adjustment amount is not zero.

According to the present disclosure of the disclosure, the HFP control operation may include: modifying the HFP adjustment amount into a preset HFP adjustment maximum value when the HFP adjustment amount is greater than the HFP adjustment maximum value; decreasing the HFP adjustment amount by 1 when the HFP adjustment amount is greater than 1 and smaller than or equal to the HFP adjustment maximum value; and setting the HFP size as a value obtained by adding or subtracting the HFP adjustment amount to or from an original HFP value.

According to the present disclosure of the disclosure, the setting the HFP size as the value obtained by adding or subtracting the HFP adjustment amount to or from the original HFP value may include: setting the HFP size as the value obtained by adding the HFP adjustment amount to the original HFP value when the first sampling value is selected as the sampling value; and setting the HFP size as the value obtained by subtracting the HFP adjustment amount from the original HFP value when the second sampling value is selected as the sampling value.

According to the present disclosure of the disclosure, the fine-tuning control operation may include: increasing the horizontal-section end point value by 1 when the first sampling value is selected as the sampling value; and decreasing the horizontal-section end point value by 1 when the second sampling value is selected as the sampling value.

According to the present disclosure of the disclosure, the method may further include: receiving a command for switching over from the video mode to the command mode; and switching over from the video mode to the command mode at a point in time when transmission of a current video frame is completed, without immediately switching over to the command mode as soon as the switching command is generated.

According to the present disclosure of the disclosure, a device for seamlessly switching over between a command mode and a video mode may include: a display serial interface (DSI) block configured to receive video data and a control signal including an external synchronization signal; a buffer block configured to delay the video data and the control signal received through the DSI block; a command-mode timing controller configured to generate an internal synchronization signal, and load data from a frame memory based on the internal synchronization signal; a sampling counting block configured to generate a sampling value by measuring a time interval between a point in time of an external synchronization signal and a point in time of an internal synchronization signal; an arithmetic block configured to generate a parameter for shifting the internal synchronization signal based on the sampling value; a sync control block configured to identify whether the internal synchronization signal and the external synchronization signal are synchronized, based on the parameter, control the internal synchronization signal to be shifted when it is identified that the internal synchronization signal and the external synchronization signal are not synchronized, and switch over between the video mode and the command mode when it is identified that the internal synchronization signal and the external synchronization signal are synchronized; and a data-path selection block configured to output video data and a command-mode control signal received from the command-mode timing controller or output video data and a video-mode control signal received from the buffer block, based on a mode selection signal received from the sync control block.

According to the present disclosure of the disclosure, the device may further include a clock domain crossing (CDC) block configured to synchronize with an internal clock domain by latching the external synchronization signal with an internal oscillator clock.

According to the present disclosure of the disclosure, the sampling counting block may include: a first counter block configured to measure a first sampling value which indicates a number of clocks from the point in time of the internal synchronization signal to the point in time of the external synchronization signal; a second counter block configured to measure a second sampling value which indicates a number of clocks from the point in time of the external synchronization signal to the point in time of the internal synchronization signal; and a first sample point register configured to store the first sampling value; and a second sample point register configured to store the second sampling value, wherein a smaller value between the first sampling value and the second sampling value is selected as a sampling value.

According to the present disclosure of the disclosure, the arithmetic block may be configured to: obtain a quotient and a remainder which are obtained by dividing a sampling value output from the sampling counting block by a total number of lines of a display panel; set the quotient as a horizontal front porch (HFP) adjustment amount; generate a fine-tuning (FT) adjustment amount by multiplying the remainder by an adjustment parameter and dividing the product of multiplication by the total number of lines; and output the HFP adjustment amount, the remainder, and the FT adjustment amount as parameters.

According to the present disclosure of the disclosure, the sync control block may include: an HFP control block configured to control the internal synchronization signal to be shifted by modifying an HFP (a waiting time after outputting valid data for a horizontal section) size with regard to all the horizontal sections in one frame based on the HFP adjustment amount; a fine-tuning control block configured to control the internal synchronization signal to be shifted by tuning a horizontal-section end point value (H end point value) with regard to a horizontal section in which an overflow occurs as an accumulated value obtained by accumulating the FT adjustment amount in every horizontal section is greater than the adjustment parameter, and a synchronization control block configured to identify whether the internal synchronization signal and the external synchronization signal are synchronized, switch over between the command mode and the video mode when it is identified that the internal synchronization signal and the external synchronization signal are synchronized, and control the HFP control block and the fine-tuning control block to operate when the internal synchronization signal and the external synchronization signal are not synchronized.

According to the present disclosure of the disclosure, the HFP control block may be configured to: modify the HFP adjustment amount into a preset HFP adjustment maximum value when the HFP adjustment amount is greater than the HFP adjustment maximum value; decrease the HFP adjustment amount by 1 when the HFP adjustment amount is greater than 1 and smaller than or equal to the HFP adjustment maximum value; set the HFP size by adding or subtracting the HFP adjustment amount to or from an original HFP value; and transmit the set HFP size to the command-mode timing controller, and the command-mode timing controller is configured to generates the internal synchronization signal based on the HFP size.

According to the present disclosure of the disclosure, the HFP control block may be configured to: set the HFP size by adding the HFP adjustment amount to an original HFP value to control a point in time of generating the internal synchronization signal to be delayed when the first sampling value is smaller than the second sampling value; and set the HFP size by subtracting the HFP adjustment amount from the original HFP value to control the point in time of generating the internal synchronization signal to be advanced when the second sampling value is smaller than the first sampling value.

According to the present disclosure of the disclosure, the fine-tuning control block may be configured to: increase the horizontal-section end point value by 1 with regard to the horizontal section where the overflow occurs, when the first sampling value is smaller than the second sampling value; decrease the horizontal-section end point value by 1 with regard to the horizontal section where the overflow occurs, when the second sampling value is smaller than the first sampling value; and transmit the horizontal-section end point value to the command-mode timing controller, and the command-mode timing controller may be configured to set a length of a corresponding horizontal section based on the horizontal-section end point value.

According to the present disclosure of the disclosure, the sync control block may be configured to: control the fine-tuning control block not to operate when the remainder is zero; and control the HFP control block not to operate when the HFP adjustment amount is zero.

According to the present disclosure of the disclosure, the synchronization control block may be configured to switch over from the video mode to the command mode after receiving a signal indicating completed transmission of a current video frame, without immediately switching over to the command mode as soon as a command for switching over from the video mode to the command mode is received when the switching command is received.

According to the present disclosure of the disclosure, a display device includes: a display panel configured to output a video; the foregoing mode switching device; a timing controller configured to obtain video data and a control signal from the mode switching device, and generate input data, a source control signal, and a gate control signal; a source drive circuit configured to generate video signals to be displayed on the display panel based on the input data and the source control signal; and a gate drive circuit configured to output a plurality of gate signals in sequence to control the display panel based on the gate control signal.

According to the present disclosure, the seamless mode transition is possible without a flicker phenomenon at the mode transition between the command mode using the internal synchronization and the video mode driven by the external synchronization signal while driving a display.

According to the present disclosure, a flicker phenomenon is prevented even when a delay or latency occurs in transition timing between the command mode and the video mode due to restrictions on the host's processor or equipment.

The effects to be achieved in the disclosure are not limited to the foregoing effects, and other effects not mentioned above will be clearly understood by a person having ordinary knowledge in the art, to which the disclosure pertains, from the following descriptions.

BRIEF DESCRIPTION OF THE DRAWINGS

The accompanying drawings, which are included to provide a further understanding of the disclosure and are incorporated in and constitute a part of the disclosure, illustrate aspects of the disclosure and together with the description serve to explain the principle of the disclosure.

In the drawings.

Throughout the drawings, the same or similar numerals may refer to the same or like elements.

DETAILED DESCRIPTION

Figure 1:
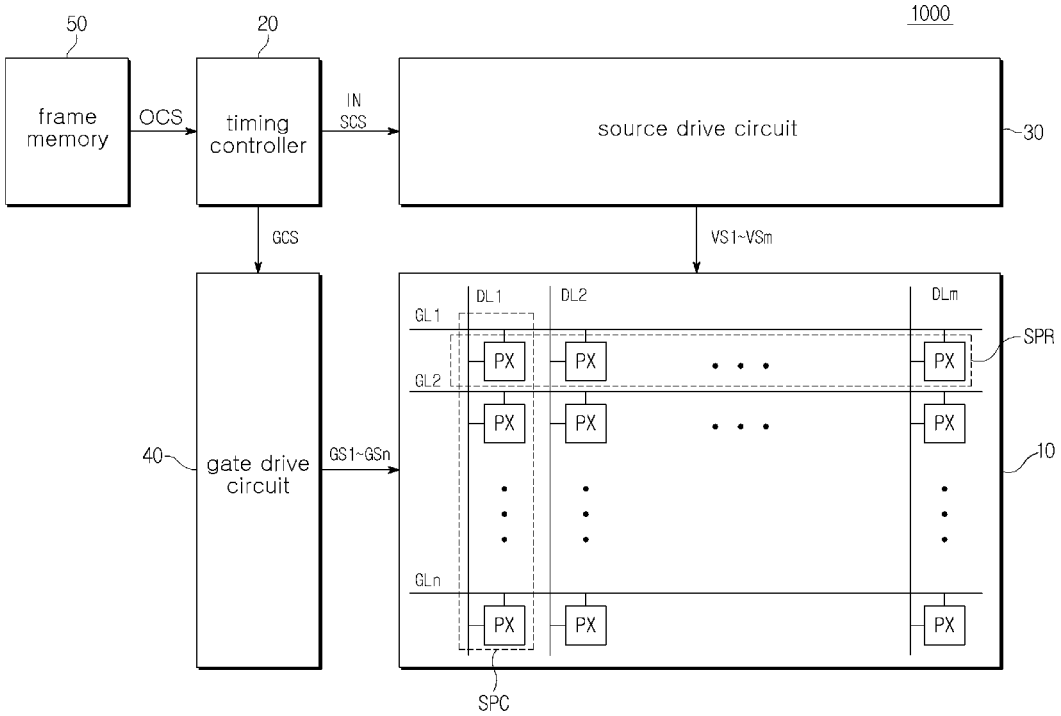
FIG. 1 illustrates a display device according to the present disclosure.

Descriptions about the disclosure are merely aspects for structural to functional descriptions, and therefore the scope of the disclosure should not be construed as being limited to the present disclosure set forth herein. In other words, the present disclosure can be variously modified and have various forms, and therefore the scope of the disclosure should be understood as including equivalents to realize technical idea.

Meanwhile, the meaning of terms described in the disclosure should be understood as follows.

The terms "first," "second," etc. are used herein to distinguish one element from other elements, and these elements should not be limited by these terms. For example, a first element could be termed a second element, and similarly, a second element could be termed a first element.

It will be understood that, when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. On the other hand, other expressions for describing the relationship between the elements, such as "between-" and "directly between-" or "neighboring to-", "directly neighboring to-", etc. should be interpreted as well.

The singular forms are intended to include the plural forms as well, unless the context clearly indicates otherwise. It will be further understood that the terms "comprise" or "include" when used herein, specify the presence of stated features, integers, steps, operations, elements, and/or components, but do not preclude the presence or addition of one or more other features, integers, steps, operations, elements, components, and/or groups thereof.

In steps, reference symbols (e.g., a, b, c, etc.) are used for the convenience of description, and do not mean the order of the steps. Unless the context clearly indicates otherwise, it may occur differently from the stated order. In other words, the steps may occur in the same order as stated, may be performed at substantially the same time, or may be performed in reverse order.

The disclosure may be embodied by a computer-readable code in a computer-readable recording medium, and the computer-readable recording medium includes all kinds of recording media on which data to be readable by a computer system is stored. Examples of the computer-readable recording medium include a read-only memory (ROM), a random-access memory (RAM), a compact disc (CD)-ROM, a magnetic tape, a floppy disk, optical data storage, etc., and further includes implementations in the form of a carrier wave (e.g., transmission over the Internet). In addition, the computer-readable recording medium can be distributed over the computer systems connected through a network, so that the computer-readable code can be stored and executed in a distribution method.

Unless otherwise defined, all terms used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and will not be interpreted in an idealized or overly formal sense unless expressly so defined here.

First, the terms used in the disclosure will be described in short.

The disclosure proposes a dynamic synchronization method of gradually shifting a point in time of an internal synchronization signal generated by an internal oscillator (OSC) of a display driver integrated-circuit (DDI) to be synchronized with a point in time of an external synchronization signal received from a host through a horizontal front porch (HFP) control method and a fine-tuning control method by which the points in times of the two synchronization signals that are asynchronous are synchronized with each other.

Here, the HFP control method refers to a method of shifting the point in time of the internal synchronization signal by changing an HFP value, which represents a waiting time after outputting valid video data for a horizontal section, so as to be applied to the whole horizontal section H.

Further, the fine-tuning control method refers to a method of shifting the point in time of the internal synchronization signal by adjusting a horizontal-section end point H End point with regard to only a specific horizontal section H.

An HFP limit setting register may be provided to limit an HFP adjustable range so that a sampling operation and an adjusting operation can be overlapped or separated according to the sections.

Clock gating is a technique to minimize waste of power by controlling a clock supplying gate. Specifically, internal blocks of a central processing unit (CPU) are grouped according to functions, and clocks are not supplied to the block which is not in use. Since power wastage is eliminated that is generated by an unused CPU block, allowing lower power consumption.

Hereinafter, the present disclosure will be described in detail in order of the accompanying drawings.

FIG. 1 illustrates a display device according to the present disclosure.

Referring to FIG. 1, a display device 1000 may include a device capable of displaying an image or a video. For example, the display device 1000 may include but is not limited to a television (TV), a smartphone, a tablet personal computer (PC), a mobile phone, a video phone, an e-book reader, a computer, a camera, or a wearable device, etc.

The display device 1000 may include a display panel 10, a timing controller 20, a source drive circuit 30, a gate drive circuit 40 and a frame memory 50. According to the present disclosure, the gate drive circuit 40 and the display panel 10 may be provided as a single body, and the timing controller 20 and the source drive circuit 30 may be called a panel control circuit. However, the present disclosure is not limited thereto.

The display panel 10 may be configured to output a video. For example, the display panel 10 may be embodied by one of a liquid crystal display (LCD), a light-emitting diode (LED) display, an organic LED (OLED) display, an active-matrix OLED (AMOLED) display, an electrochromic display (ECD), a digital mirror device (DMD), actuated mirror device (AMD), a grating light valve (GLV), a plasma display panel (PDP), an electroluminescent display (ELD), and a vacuum fluorescent display (VFD), but not limited thereto.

The display panel 10 may include a plurality of subpixels PX for emitting light. The plurality of subpixels PX may be arranged in rows and columns. For example, the plurality of subpixels PX may be arranged in a lattice structure including n rows and m columns (where n and m are natural numbers). In this case, the rows in which the subpixels PX are arranged will be called a subpixel row SPR, and the columns in which the subpixels PX are arranged will be called a subpixel column SPC. For example, with respect to FIG. 1, a first subpixel column, a second subpixel column, . . . , an $m^{th}$ subpixel column may be arranged from left to right.

The subpixels PX may be a basic unit from which light is emitted. The subpixels PX may include driving elements, respectively. According to the aspects, each of the subpixels PX may emit one of red light, green light and blue light, but is not limited thereto. For example, the subpixel PX may emit white light.

According to the aspects, the subpixels PX may include light emitting elements configured to emit light, and a pixel circuit configured to drive the light emitting elements. The pixel circuit may include a plurality of switching devices, and the plurality of switching devices may control the flow of video signals and driving voltages applied to the light emitting elements. For example, the light emitting element may include a light emitting diode (LED), an organic LED (OLED), a quantum dot LED (QLED) or a micro-LED, but there are no limits to the kinds of light emitting elements according to the aspects of the disclosure.

The subpixels PX of the display panel 10 may be driven in units of gate lines (hereinafter, referred to as "lines"). In other words, the subpixels PX may be driven in units of subpixel rows. For example, the subpixels arranged in one gate line may be driven during a first section, and the subpixels arranged in another gate line may be driven during a second section following the first section. In this case, a unit time section during which the subpixels PX are driven may be referred to as one horizontal section (1H time or line).

The display panel 10 may include an active display area in which the foregoing pixels for displaying a video are present, and an inactive area in which a video is not displayable.

Figure 2:
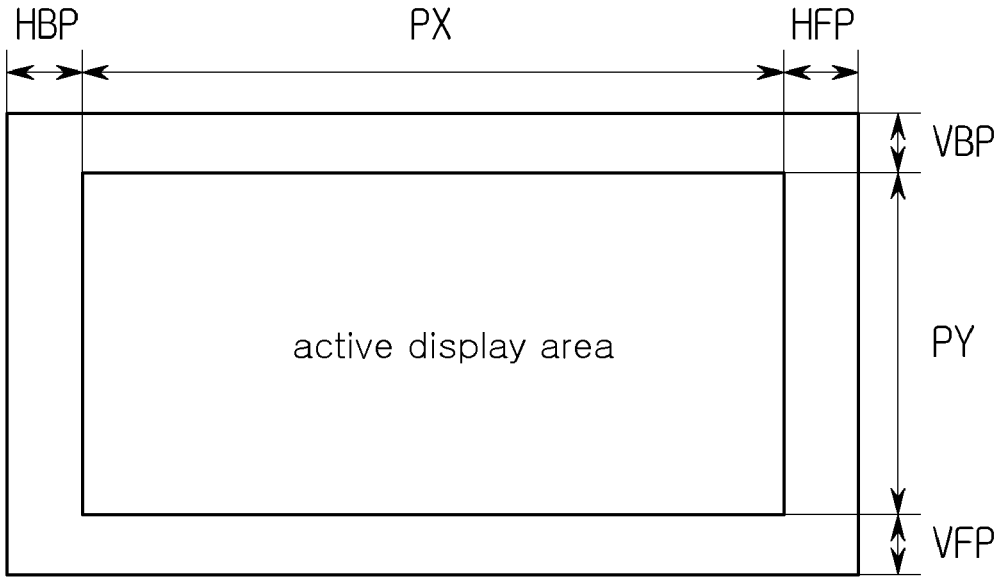
FIG. 2 illustrates display timing parameters when a display panel is driven.

FIG. 2 illustrates the timing parameters of the frame when the display panel 10 is driven.

Referring to FIG. 2, PX and PY may vary depending on resolutions of a display. For example, a display having a resolution of 1920×1080 may have PX of 1920 and PY of 1080.

Meanwhile, inactive (blank) sections of a horizontal front porch (HFP) and a horizontal back porch (HBP) may be present in the front and back of the lines in the frame. Therefore, clocks may be consumed as much as the HFP and the HBP before and after displaying video data for the lines. Further, inactive (blank) sections of a vertical front porch (VFP) and a vertical back porch (VBP) may be present in the start and end of the frame. Therefore, lines may be consumed as much as the VFP and the VBP before and after actually displaying the video data.

As one frame includes both the active section and the inactive section, one horizontal section may be HBP+PX+HFP, and the number of lines may be VBP+PY+VFP. In the inactive section, the video data may be dummy data.

To display one piece of frame data, a vertical synchronization signal Vsync and a horizontal synchronization signal Hsync may be used. The vertical synchronization signal may be generated with the start of the frame data, and the horizontal synchronization signal may be generated with the start of the data in one line. The horizontal synchronization signal and the vertical synchronization signal may be used as control signals for displaying the frame data on the display panel 10.

Referring back to FIG. 1, the frame memory 50 may be configured to temporarily store video data of one frame to be displayed on the display panel 10 and transmit the video data to the timing controller 20 based on the control signal of the timing controller 20. The frame memory may employ a volatile memory such as a static random access memory (SRAM), but is not limited thereto. Alternatively, the frame memory may use various kinds of memories.

The timing controller 20 may be configured to obtain video data from the frame memory 50, and properly process or convert the video data, thereby generating input data IN. The timing controller 20 may transmit the input data IN to the source drive circuit 30.

The timing controller 20 may be configured to receive an external control signal OCS from an external device. The external control signal OCS may include but is not limited to a horizontal synchronization signal Hsync, a vertical synchronization signal Vsync, and a clock signal OCLK.

The timing controller 20 may control operations of the source drive circuit 30 and the gate drive circuit 40, based on the external control signal. According to the aspects, the timing controller 20 may be configured to receive the external control signal OCS, and generate a source control signal SCS for controlling the source drive circuit 30 and a gate control signal GCS for controlling the gate drive circuit 40.

The source drive circuit 30 may be configured to generate video signals VS1 to VSm corresponding to a video displayed in the display panel 10, and output the generated video signals VS1 to VSm to the display panel 10, based on the input data IN and the source control signal SCS, and output the generated video signals. According to the aspects, the source drive circuit 30 may generate the video signals VS1 to VSm having a voltage level corresponding to the input data IN.

The source drive circuit 30 may be configured to sequentially output the video signals VS1 to VSm to be output according to the subpixel rows of the display panel 10. According to the aspects, the source drive circuit 30 may be configured to provide the video signals VS1 to VSm, to be displayed in the 1H section during the 1H section, to the subpixels PX driven in the 1H section. The video signals VS1 to VSm output from the source drive circuit 30 may be transmitted to the subpixels PX through data lines DL1 to DLm of the display panel 10.

The gate drive circuit 40 may be configured to sequentially output a plurality of gate signals GS1 to GSn in response to the gate control signal GCS.

The gate signals GS1 to GSn are signals for turning on the subpixels PX connected to gate lines GL1 to GLn, respectively, and may be applied to gate terminals of transistors respectively included in the subpixels PX. According to the aspects, each of the gate signals GS1 to GSn may include at least one of a scan signal, a light emitting signal, and an initialization signal.

According to the aspects, the frame memory 50, the timing controller 20, the source drive circuit 30, and the gate drive circuit 40 may be embodied as a single integrated circuit (IC) as they are all included in a driver IC for the command mode. According to another aspect, three circuits except the frame memory 50 may be embodied as a single IC as included in a driver IC for the video mode only. According to still another aspect, the timing controller 20, the source drive circuit 30 and the gate drive circuit 40 may be embodied as mounted to the display panel 10.

Figure 3:
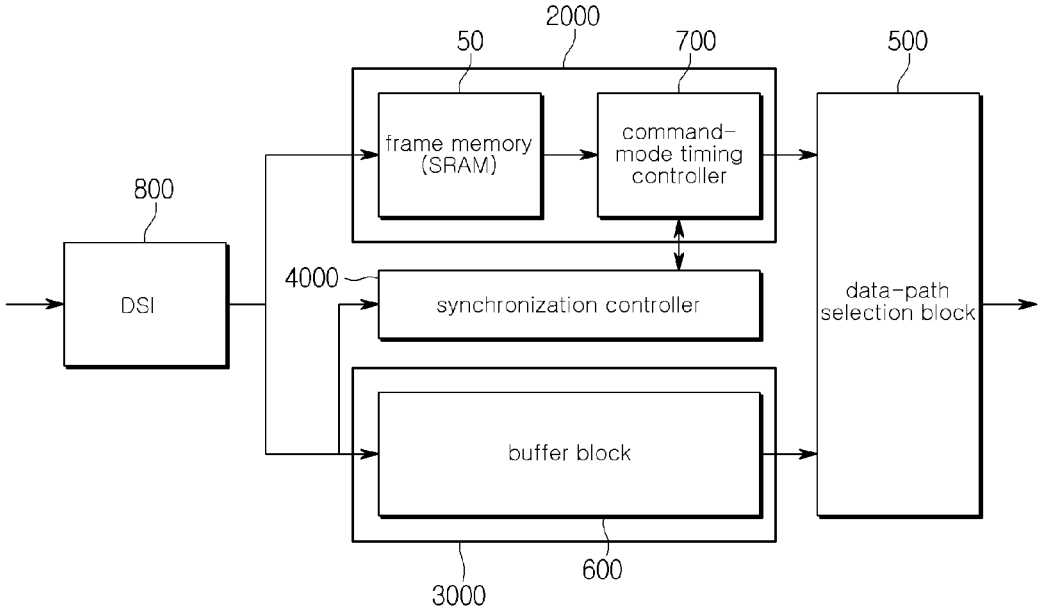
FIG. 3 illustrates an example of a data path in a command mode and a video mode.

FIG. 3 illustrates an example of a data path in the command mode and the video mode.

Referring to FIG. 3, in the command mode, video data received from an external device or a host may be stored in the frame memory 50 via a display serial interface (DSI) 800, and a command-mode timing controller 700 may obtain and transmit the video data from the frame memory 50 to a data-path selection block 500 while generating a control signal including internal synchronization signals such as a vertical synchronization signal Vsync and a horizontal synchronization signal Hsync, thereby displaying a video on the display panel 10.

In the video mode, a video and a control signal including external synchronization signals such as a vertical synchronization signal Vsync and a horizontal synchronization signal Hsync may be received from the external device or the host via the DSI 800, and transmitted to the data-path selection block 500. The data-path selection block 500 may output the control signal and the video data along a path 3000 according to the video mode or output the control signal and the video data along a path 2000 according to the command mode, based on the control signal about whether to select the video mode or the command mode.

In this case, a flicker may occur during mode transition because the internal synchronization signal generated in the command mode is not synchronized with the external synchronization signal used in the video mode.

According to the disclosure, for a seamless transition, i.e., for preventing the flicker from occurring during the mode transition, it is proposed to add a synchronization controller 4000 for controlling the external synchronization signal and the internal synchronization signal to be synchronized with each other. In this case, a buffer block 600 may also be added on the path 3000 for the video mode to buffer the signals received through the DSI 800 while the synchronization controller 4000 synchronizes the external synchronization signal and the internal synchronization signal with each other.

The device shown in FIG. 3, which switches over between the video mode and the command mode without the flicker, may be used to replace the timing controller 20 of the display device shown in FIG. 1 or may be placed between the frame memory 50 and the timing controller 20 and provide the control signal and the video data to the timing controller 20.

First, the operations of the device shown in FIG. 3, which switches over between the video mode and the command mode without the flicker, will be described.

Figure 4:
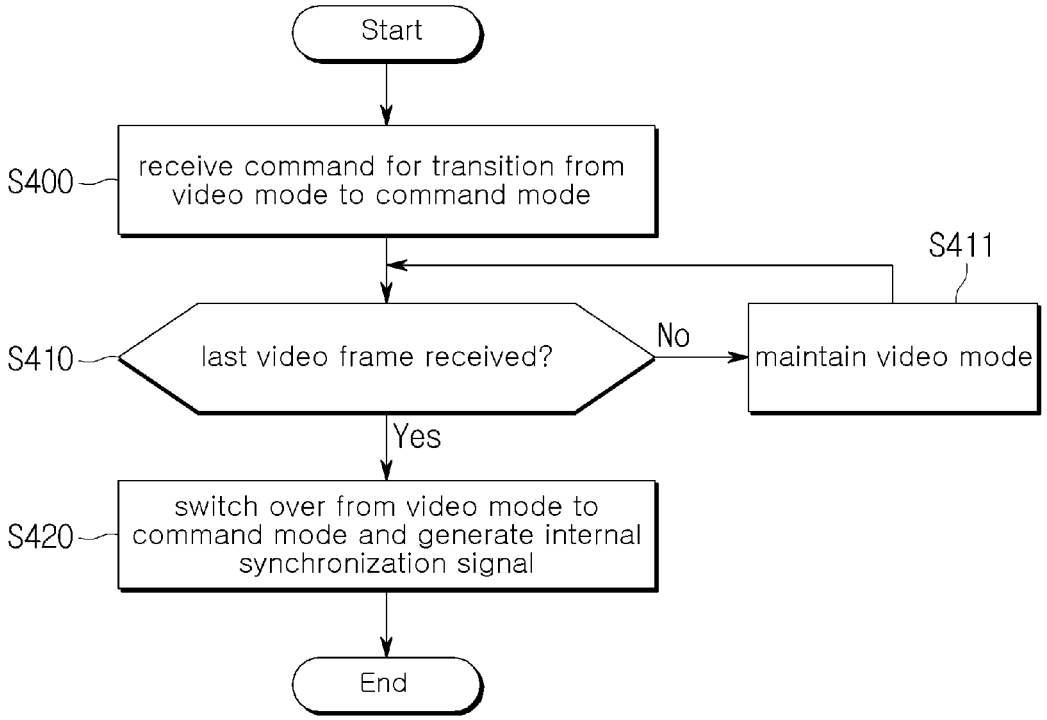
FIG. 4 is a flowchart showing a method of synchronizing an internal synchronization signal and an external synchronization signal at a transition from the video mode to the command mode according to the present disclosure.

FIG. 4 is a flowchart showing a method of synchronizing an internal synchronization signal and an external synchronization signal at the transition from the video mode to the command mode according to the present disclosure.

Referring to FIG. 4, at operation S400, the display device 1000 or the mode transition device may receive a command for the transition from the video mode driven by the external synchronization signal to the command mode using the internal synchronization signal.

At operation S410, the mode transition device may not immediately switch over to the command mode as soon as the command for the transition is received, but identify whether transmission of a video frame being currently transmitted to the display panel 10 is completed.

At operation S411, when it is identified that the transmission of the video frame is not completed yet, the video mode may be maintained.

At operation S420, after the transmission of the video frame is completed, the mode transition device switches over from the video mode to the command mode and generates the internal synchronization signal.

The external synchronization signal may be input when the transmission of one video frame is completed and the transmission of the next video frame starts. Therefore, when the internal synchronization signal is generated by the foregoing operations after the transmission of one video frame is completed, it is possible to synchronize the internal synchronization signal with the external synchronization signal. Therefore, it is possible to prevent the flicker from occurring.

Figure 5:
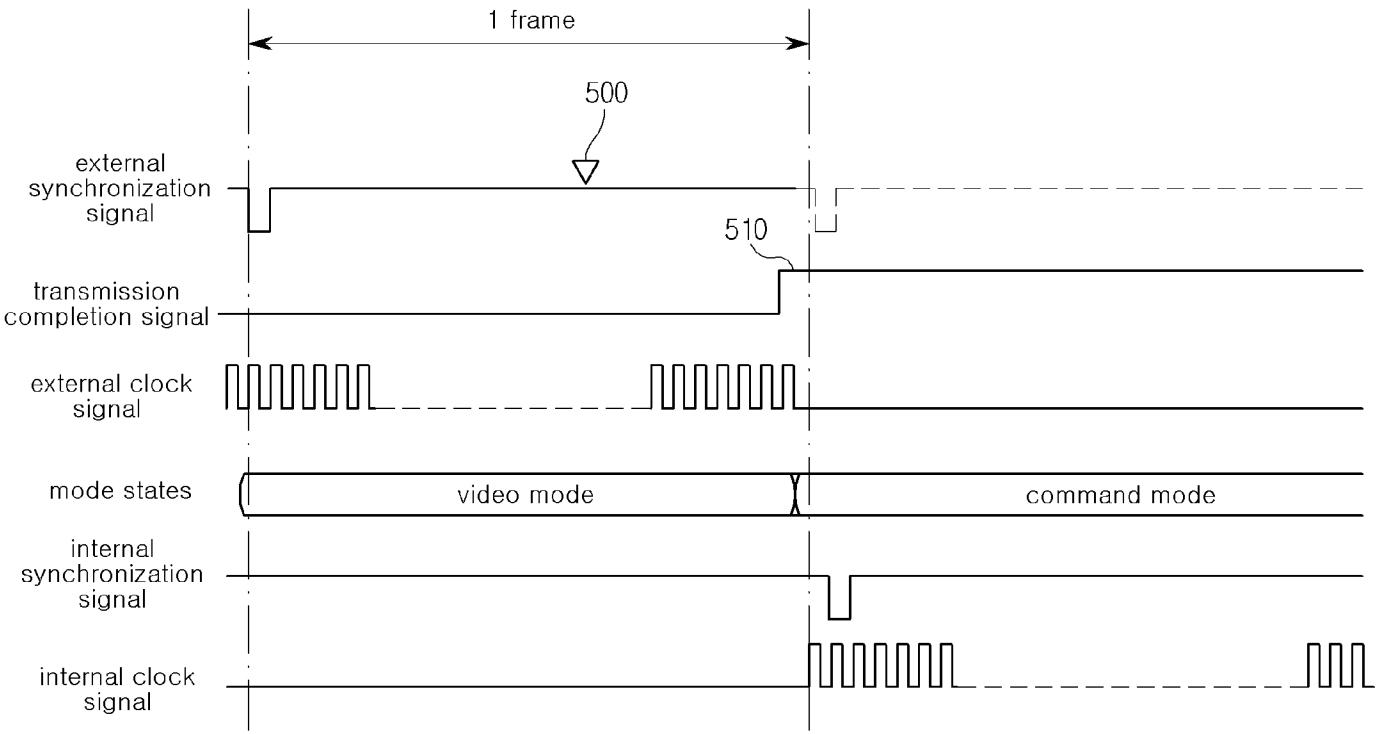
FIG. 5 is a diagram illustrating operations at a transition from a video mode to the command mode according to the present disclosure.

FIG. 5 illustrates operations at the transition from the video mode to the command mode according to the present disclosure.

Referring to FIG. 5, a command (VID_ON=0) for transition from the video mode to the command mode may be received at a point 500 in the middle of transmitting one frame. Then, as shown in FIG. 5, the mode transition device waits for a transmission completion signal without immediately switching over to the command mode and generating the internal synchronization signal. The mode transition device may perform the mode transition for the display device from the video mode to the command mode at a point 510 of recognizing the transmission completion signal. Further, it is possible to generate the internal synchronization signal.

According to an aspect, as shown in FIG. 5, an internal clock signal may not be applied to internal logic by gating through gating control in the video mode to reduce power consumption, but may be applied to the internal logic by releasing the gating after switching over to the command mode. Likewise, an external clock signal may not be applied to the internal logic by the gating in the command mode even though the gating is released in the video mode.

Figure 6:
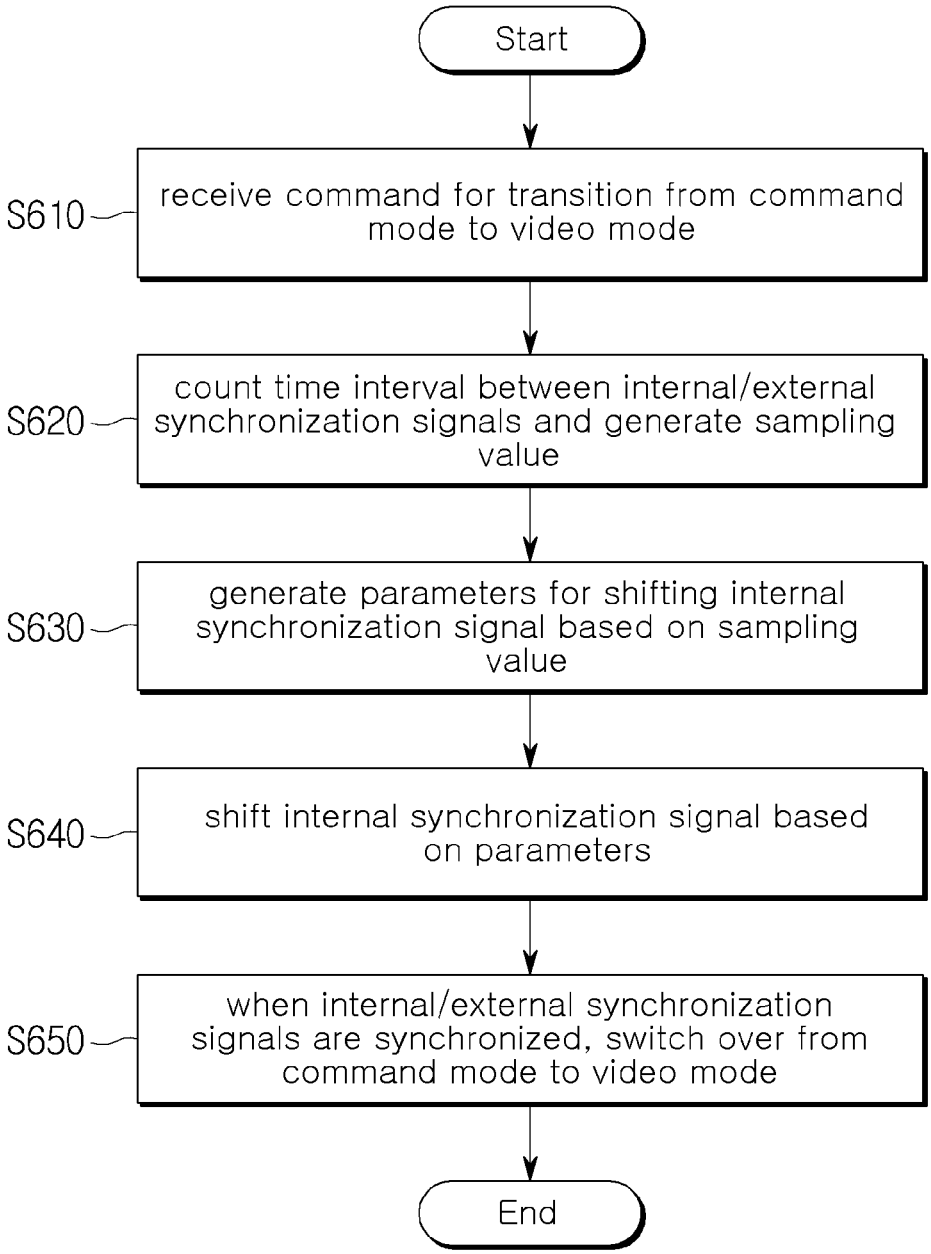
FIG. 6 is a flowchart showing a method of synchronizing the internal synchronization signal and the external synchronization signal at a transition from the command mode to the video mode according to the present disclosure.

FIG. 6 is a flowchart showing a method of synchronizing the internal synchronization signal and the external synchronization signal at the transition from the command mode to the video mode according to the present disclosure.

Referring to FIG. 6, at operation S610, the display device 1000 or the mode transition device may receive a command (VID_ON=1) for the transition from the command mode driven by the internal synchronization signal to the video mode using the external synchronization signal.

At operation S620, the mode transition device may count a time interval between the internal synchronization signal and the external synchronization signal. Here, the time interval may be counted as the number of clocks from an internal oscillator, and a sampling value may be generated based on the number of counted clocks.

At operation S630, the mode transition device may generate parameters for shifting the internal synchronization signal based on the sampling value.

At operation S640, the mode transition device may shift the internal synchronization signal based on the generated parameter. In this case, the internal synchronization signal may be shifted by the HFP control method and the fine-tuning control method (to be described later).

At operation S650, when the synchronization between the internal synchronization signal and the external synchronization signal is completed, the mode transition device may switch the display device 1000 over from the command mode using the internal synchronization signal to the video mode driven by the external synchronization signal.

Figure 7:
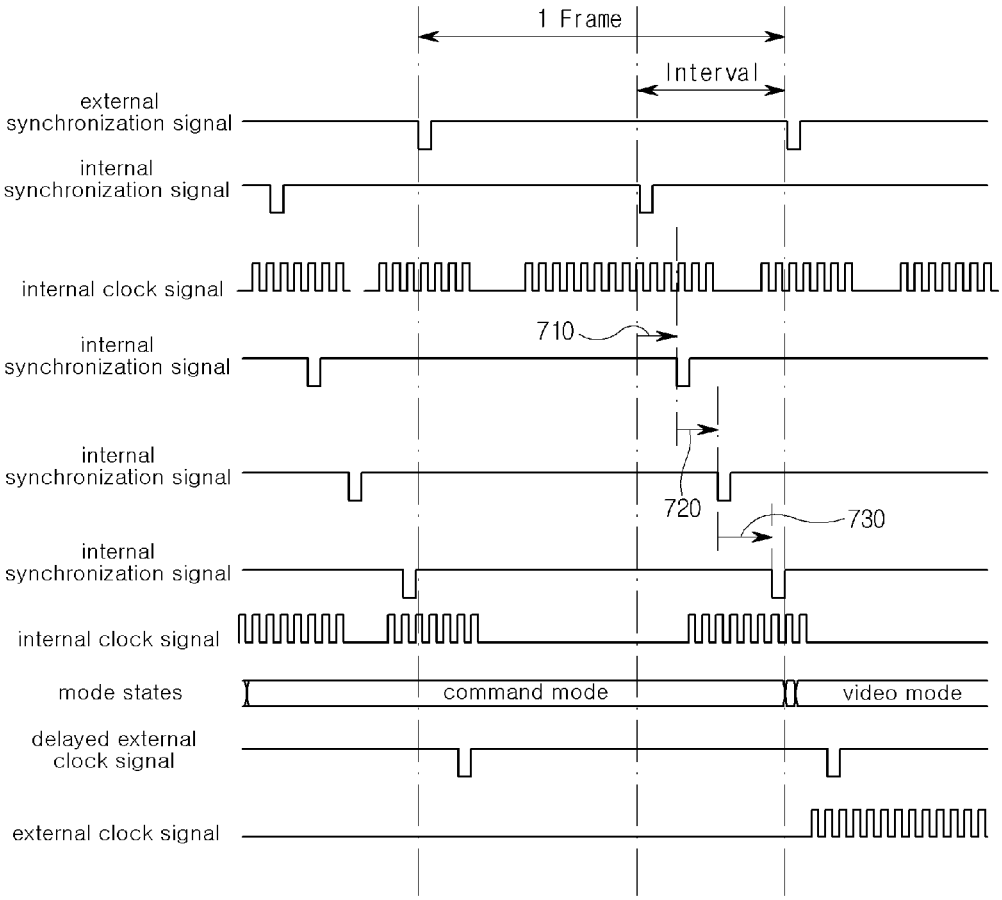
FIG. 7 is a diagram illustrating operations performed when an interval from an internal synchronization signal to the external synchronization signal is smaller than an interval from the external synchronization signal to the internal synchronization signal at the transition from the command mode to the video mode according to the present disclosure.

FIG. 7 illustrates operations performed when an interval from the internal synchronization signal to the external synchronization signal is smaller than an interval from the external synchronization signal to the internal synchronization signal at the transition from the command mode to the video mode according to the present disclosure.

Referring to FIG. 7, when the interval from the internal synchronization signal to the external synchronization signal is smaller than the interval from the external synchronization signal to the internal synchronization signal, the mode transition device may shift the points in time of the internal synchronization signals in directions to be gradually delayed (710, 720, 730) by the HFP control method or the fine-tuning control method.

Here, the synchronization is completed when the point in time of the internal synchronization signal being shifted falls within a preset target range, and it is thus possible to switch the command mode over to the video mode.

Figure 8:
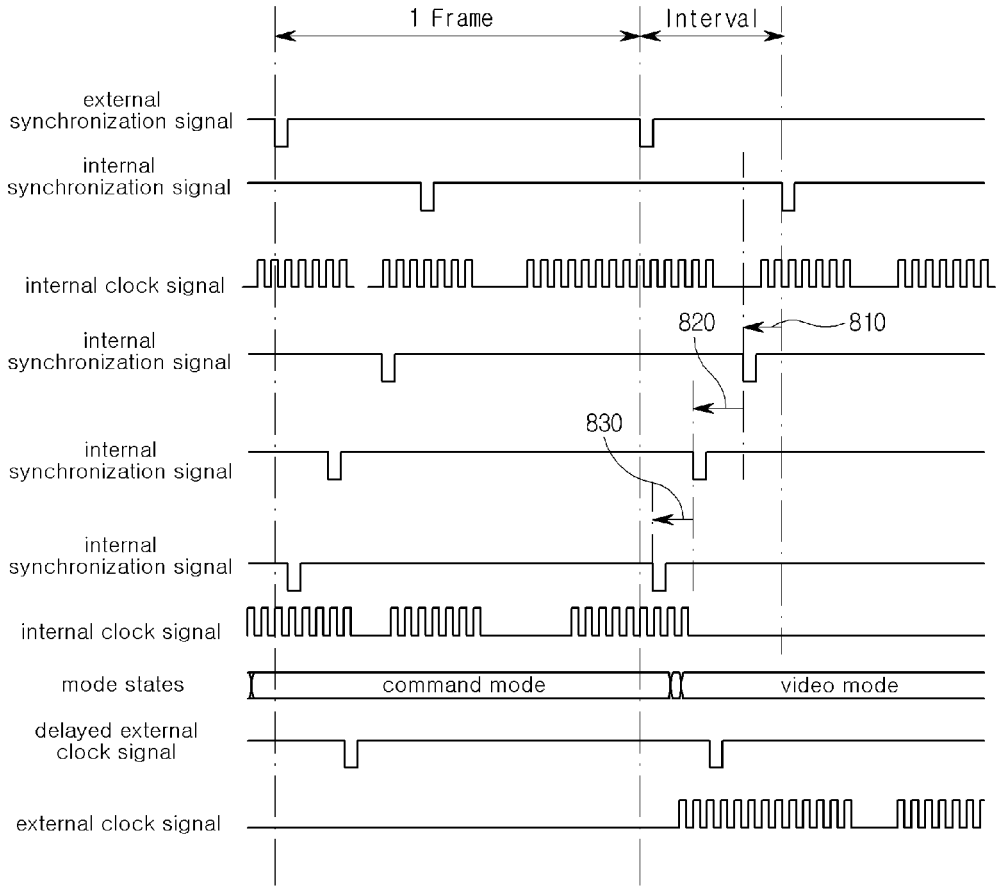
FIG. 8 is a diagram illustrating operations performed when the interval from the external synchronization signal to the internal synchronization signal is smaller than the interval from the internal synchronization signal to the external synchronization signal at a transition from the command mode to the video mode according to the present disclosure.

FIG. 8 illustrates operations performed when the interval from the external synchronization signal to the internal synchronization signal is smaller than the interval from the internal synchronization signal to the external synchronization signal at the transition from the command mode to the video mode according to the present disclosure.

Referring to FIG. 8, when the interval from the external synchronization signal to the internal synchronization signal is smaller than the interval from the internal synchronization signal to the external synchronization signal, the mode transition device may shift the points in time of the internal synchronization signals in directions to be gradually advanced (810, 820, 830) by the HFP control method or the fine-tuning control method.

Here, it is possible to switch over from the command mode to the video mode when the point in time of the internal synchronization signal being shifted falls within a preset target range.

Figure 9:
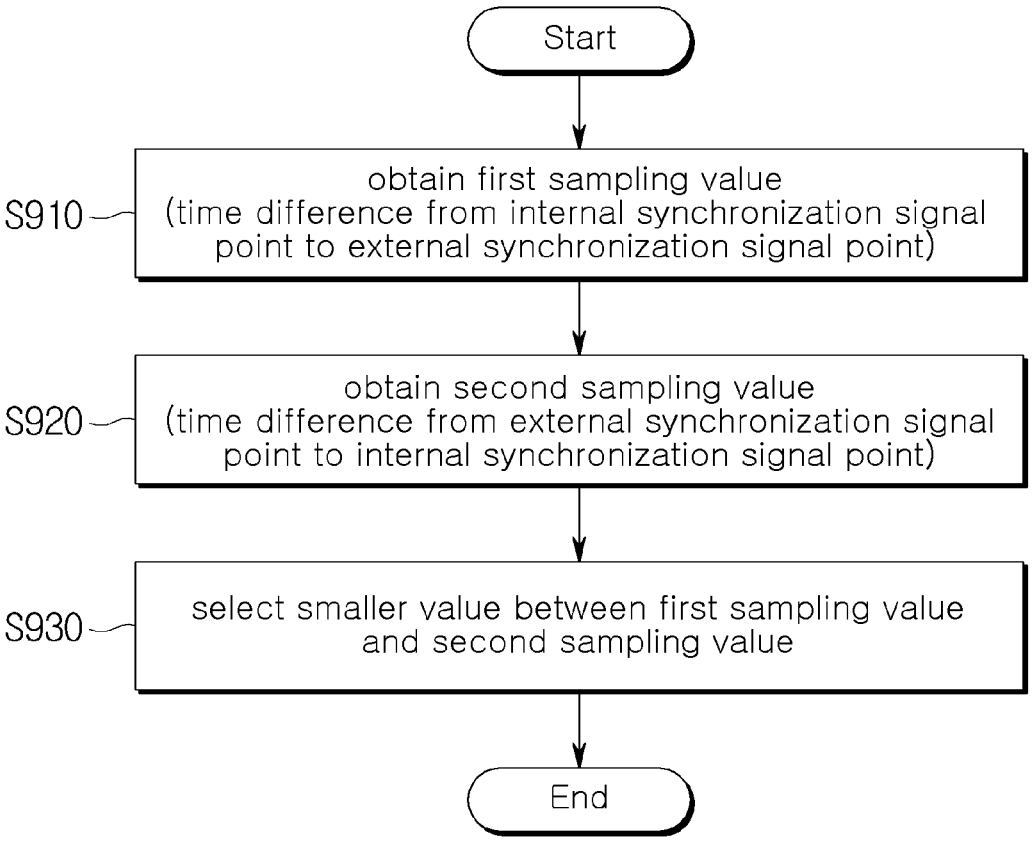
FIG. 9 is a flowchart showing a method of generating a sampling value by counting a time interval between the internal synchronization signal and an external synchronization signal according to the present disclosure.

FIG. 9 is a flowchart showing a method of generating a sampling value by counting a time interval between the internal synchronization signal and the external synchronization signal according to the present disclosure. FIG. 9 may show an aspect of the operation S620 in FIG. 6.

Referring to FIG. 9, at operation S910, the mode transition device may obtain a first sampling value that indicates the time interval from the point in time of the internal synchronization signal to the point in time of the external synchronization signal.

Further, at operation S920, the mode transition device may obtain a second sampling value that indicates the time interval from the point in time of the external synchronization signal to the point in time of the internal synchronization signal.

At operation S930, the mode transition device may select a smaller value between the first sampling value and the second sampling value, and identify the selected value as a final sampling value.

In the operations S910 and S920, the sampling values for indicating the time intervals between the points in time of the two synchronization signals may be based on the number of clocks of the internal oscillator during the corresponding time interval.

Figure 10:
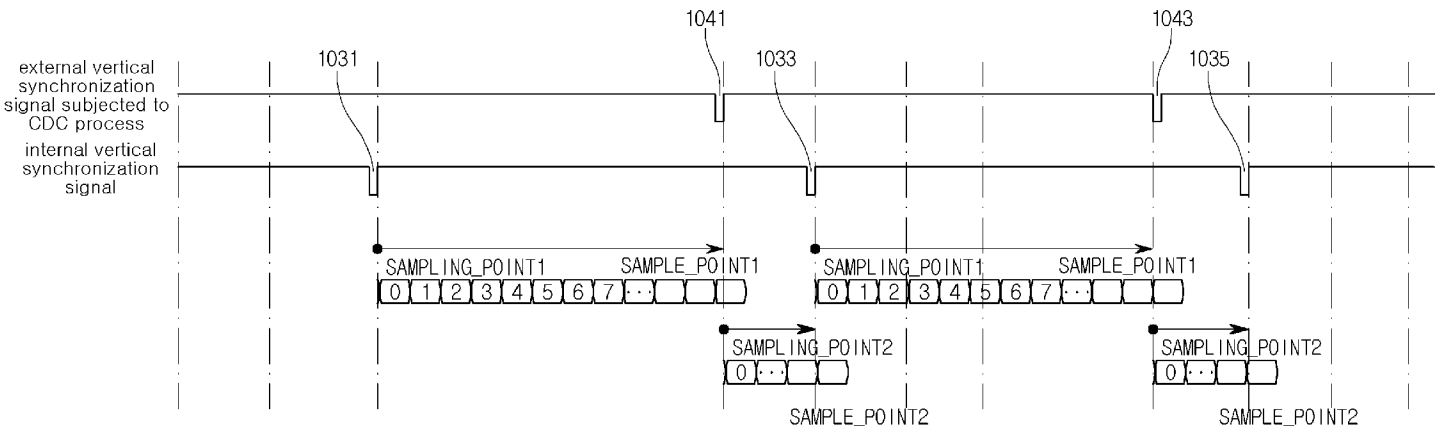
FIGS. 10 and 11 are diagrams showing examples for describing the operation of identifying the sampling value based on the flowchart of FIG. 9.
Figure 11:
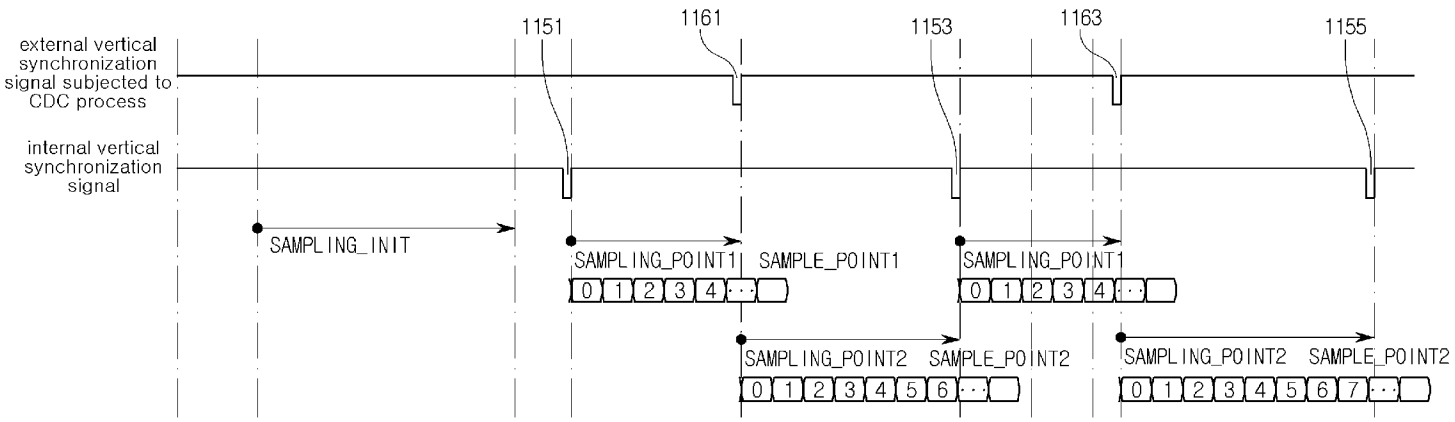

FIGS. 10 and 11 show examples for describing the operation of identifying the sampling value based on the flowchart of FIG. 9.

Referring to FIG. 10, the mode transition device may start counting from an internal synchronization-signal point 1031, end the counting at an external synchronization-signal point 1041, and store a first sampling value SAMPLE_POINT1, which is a counting value up to that time.

Further, the mode transition device may start counting from the external synchronization-signal point 1041, end the counting at an internal synchronization-signal point 1033, and store a second sampling value SAMPLE_POINT2, which is a counting value up to that time.

Referring to FIG. 11, the mode transition device may start counting from an internal synchronization-signal point 1151, end the counting at an external synchronization-signal point 1161, and store the first sampling value SAMPLE_POINT1, which is a counting value up to that time.

Further, the mode transition device may start counting from the external synchronization-signal point 1161, end the counting at an internal synchronization-signal point 1153, and store the second sampling value SAMPLE_POINT2, which is a counting value up to that time.

The foregoing operation may be repetitively performed as shown in FIGS. 10 and 11.

The difference between FIG. 10 and FIG. 11 is based on the difference between the first sampling value and the second sampling value. FIG. 10 shows a case that the second sampling value is small, and FIG. 11 shows a case that the first sampling value is small. To reduce the time taken in performing the synchronization, a smaller sampling value may be used in synchronizing the external synchronization signal and the internal synchronization signal. Therefore, in the operation 930 of FIG. 9, the mode transition device may select the second sampling value as the sampling value in the case of FIG. 10, and select the first sampling value as the sampling value in the case of FIG. 11.

Figure 12:
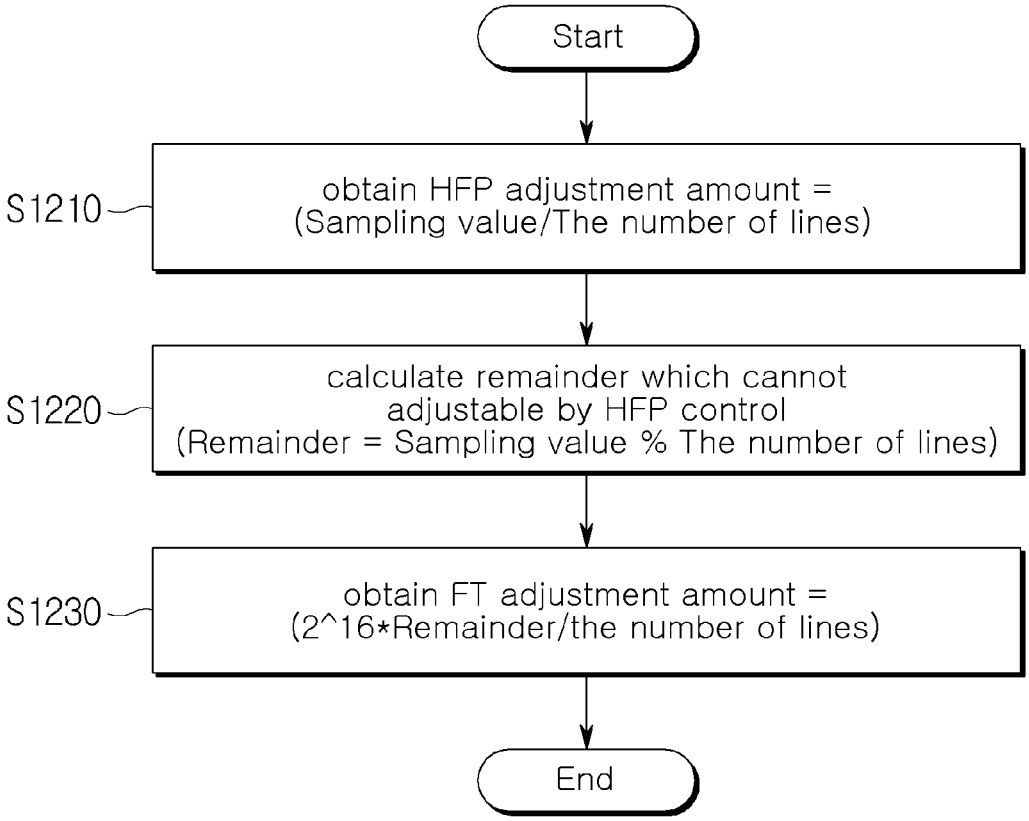
FIG. 12 is a flowchart showing a method by which a mode transition device generates parameters to be used for shifting the internal synchronization signal.

FIG. 12 is a flowchart showing a method by which the mode transition device generates parameters to be used for shifting the internal synchronization signal. FIG. 12 may show an aspect of the operation S630 in FIG. 6.

The parameters, which the mode transition device uses to shift the internal synchronization signal, may include an HFP adjustment amount used in the HFP control method, an FT adjustment amount used in the fine-tuning control method, and a remainder.

In the HFP control method, an HFP value applied to all the horizontal sections H included in one frame, i.e., included in between two adjacent vertical synchronization signals Vsync is changed to thereby shift the internal synchronization-signal point. In this case, the HFP value is changed throughout all the lines, and therefore a point at which the next vertical synchronization signal is generated may be considerably different from an original point.

In the fine-tuning control method, a horizontal section end point H End Point is adjusted with regard to only a specific horizontal section, thereby shifting the internal synchronization-signal point.

Referring to FIG. 12, at operation S1210, the mode transition device may obtain the HFP adjustment amount based on a quotient which is obtained by dividing the sampling value by the number of horizontal sections, i.e., lines in one frame, as shown in the following equation 1.

$$\text{HFP adjustment amount} = \text{Sampling value} / \text{The number of lines} \quad \text{[Equation 1]}$$

Here, as shown in FIG. 2, the number of lines may involve a VBP (vertical back porch), a PV, and a VFP (vertical front porch).

Further, the fine-tuning control is for adjustment as much as a sampling number which is not adjusted by the HFP control. To this end, at operation S1220, the mode transition device may calculate the remainder, i.e., the sampling number, which is not adjustable by the HFP control, as shown in the following equation 2.

$$\text{Remainder} = \text{Sampling value} \ \% \ \text{The number of lines} \quad \text{[Equation 2]}$$

Further, another parameter for the fine-tuning control, i.e., the FT adjustment amount may be obtained by multiplying an adjustment parameter by the remainder and dividing it by the number of lines, as shown in the following equation 3. In equation 3, the adjustment parameter may be greater than the maximum value of the FT adjustment amount by 1. For example, when the FT adjustment amount is represented by 16 bits, the maximum value that the FT adjustment amount can have is "FFFFh," and thus the adjustment parameter may be "10000h," i.e., 2^16.

FT adjustment amount=Adjustment parameter*Remainder/the number of lines [Equation 3]

Figure 13:
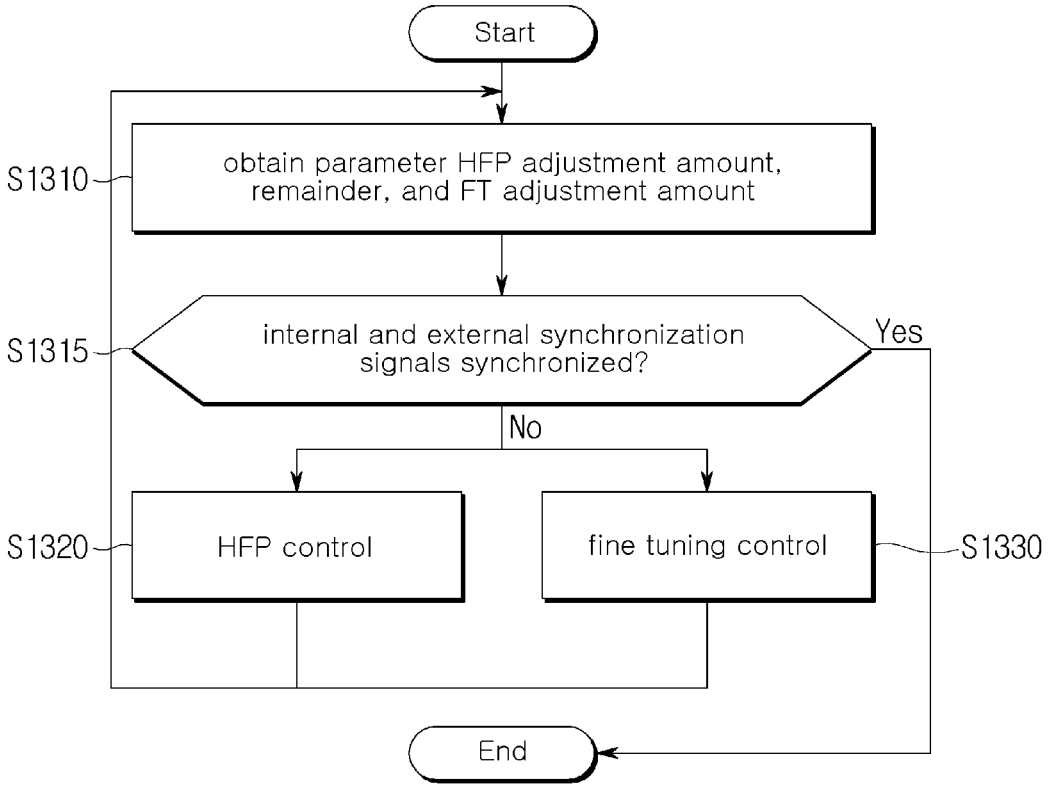
FIG. 13 is a flowchart showing a method of shifting the internal synchronization signal based on the parameter.

FIG. 13 is a flowchart showing a method of shifting the internal synchronization signal based on the parameter. FIG. 13 may show an aspect of the operation S640 in FIG. 6.

Referring to FIG. 13, at operation S1310, the mode transition device may obtain the parameter HFP adjustment amount, the remainder and the FT adjustment amount, which are generated in the operation S630.

At operation S1315, the mode transition device may identify whether the internal synchronization signal and the external synchronization signal are synchronized. According to an aspect, the mode transition device may identify whether the internal synchronization signal and the external synchronization signal are synchronized by identifying whether the internal synchronization signal falls within the target range of the external synchronization signal, based on the HFP adjustment amount and/or the remainder. When it is identified that the internal synchronization signal and the external synchronization signal are synchronized, the mode transition device no longer needs to perform control for shifting the internal synchronization signal and may terminate the control.

When it is identified that the internal synchronization signal and the external synchronization signal are not synchronized, and the internal synchronization signal is required to be shifted, the mode transition device may perform the HFP control operation of the operation S1320 and the fine-tuning control operation of the operation S1330 based on the received parameters.

The fine-tuning control operation may be performed only when the remainder is not 0.

Further, according to an aspect, when both the HFP control operation and fine-tuning control operation are needed, the HFP control operation may be performed first and the fine-tuning control operation may be then performed; the fine-tuning control operation may be performed first and the HFP control operation may be then performed; or the HFP control operation and fine-tuning control operation may be performed simultaneously.

At operation S1320, the HFP control operation may be performed to change the HFP adjustment amount first.

1) When the HFP adjustment amount is greater than a preset HFP adjustment maximum value HFP_LIMIT, the HFP adjustment amount may be changed into the HFP adjustment maximum value. Thus, it is possible to eliminate problems such as some driving-time shortages, an excessively downward frame-frequency, or the like that may occur while driving a display. When the HFP adjustment amount is greater than the HFP adjustment maximum value, it is possible to continuously perform the adjusting operation by successively reflecting the sampling value generated in the operation S620. Therefore, it is possible to quickly reach near the target external synchronization signal. However, when the sampling operation in the operation S620 and the adjusting operation in the operation S640 are performed simultaneously, a sampling result may be relatively inaccurate.

2) When the HFP adjustment amount is greater than 1 and smaller than or equal to the HFP adjustment maximum value, it may be changed such as the HFP adjustment amount=the HFP adjustment amount−1. Thus, it is possible to make the adjusting operation of when the HFP adjustment amount becomes 1 be always performed. Further, in this case, the sampling value in the operation S620 obtained while the adjusting operation in the operation S640 is performed is not used, in other words, the sampling operation in the operation S620 is performed separately from the adjusting operation in the operation S640, so that a relatively accurate sampling value can be obtained, thereby achieving precise adjustment. However, it may take more time in the adjustment.

3) When the HFP adjustment amount is smaller than or equal to 1, the HFP adjustment amount may be maintained as it is. Thus, when the calculated HFP adjustment amount is 1, the adjusting operation for the minimum HFP adjustment amount of 1 may be carried out. Even in this case, the sampling value in the operation S620 obtained while the adjusting operation in the operation S640 is performed is not used, in other words, the sampling operation in the operation S620 is performed separately from the adjusting operation in the operation S640, so that a relatively accurate sampling value can be obtained, thereby achieving precise adjustment. However, it may take more time in the adjustment.

Next, the HFP control operation may be modified to use the finally adjusted HFP adjustment amount in setting an HFP size.

The HFP size may be decreased or increased based on adjustment direction information of the internal synchronization signal. When a small value selected in FIG. 9 is the first sampling value, the internal synchronization signal needs to be delayed for synchronization with the external synchronization signal and the synchronous. When the selected small value is the second sampling value, the internal synchronization signal needs to be advanced for synchronization with the external synchronization signal. Therefore, the HFP adjustment amount may be added to an original HFP value so as to increase the HFP size when the sampling value is the first sampling value, and the HFP adjustment amount may be subtracted from the original HFP value so as to decrease the HFP size when the sampling value is the second sampling value.

The final HFP size value may be transmitted to the command-mode timing controller provided in the mode transition device that generates the internal synchronization signal, and every horizontal synchronization signal of the command-mode timing controller may be generated in sync with a time interval of "HBP+PX+HFP." Because the same number of horizontal synchronization signals, i.e., the same number of lines is provided in between the vertical synchronization signals, the internal synchronization signal may be shifted toward the external synchronization signal while the next vertical synchronization signal is generated later or earlier than the original vertical synchronization signal.

The operations shown in FIG. 13 may be repeated until it is identified that the internal synchronization signal and the external synchronization signal are synchronized with each other.

Figure 14:
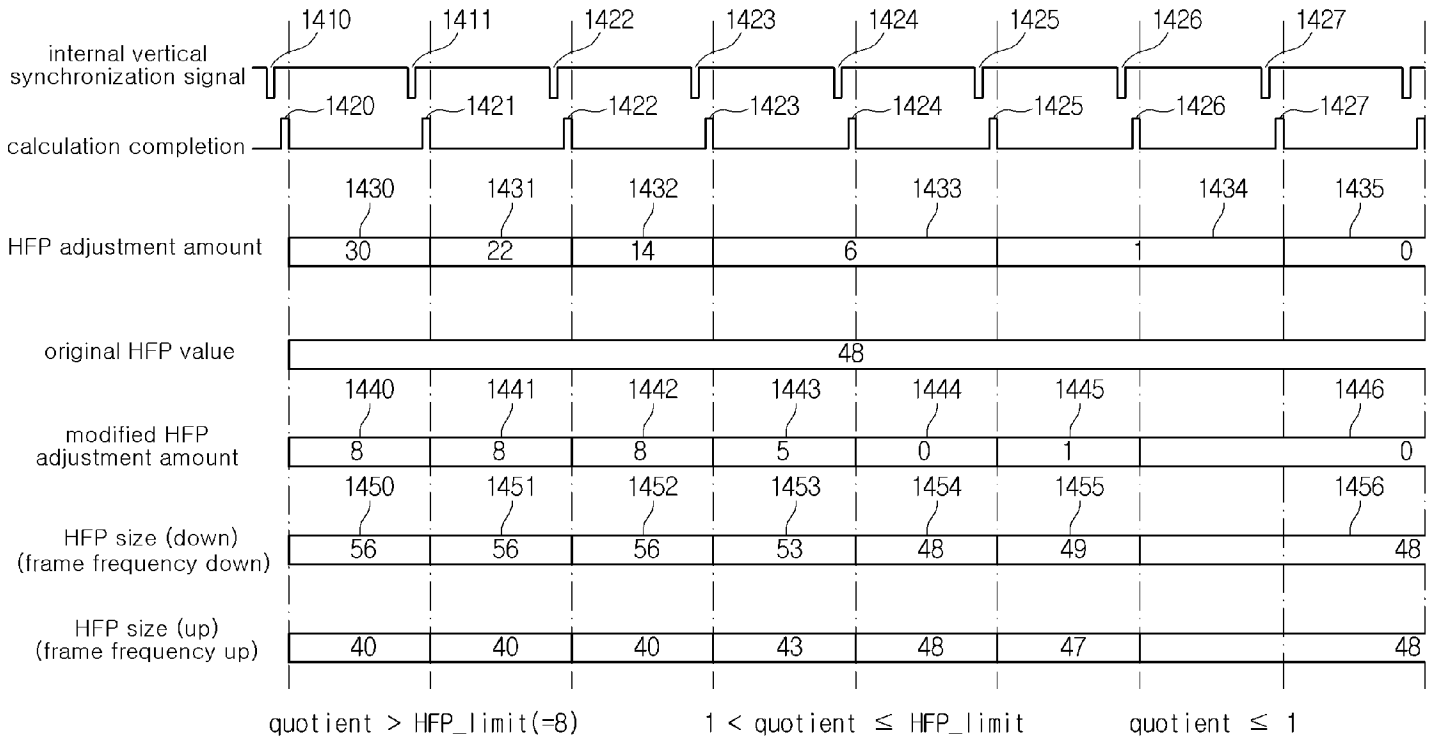
FIG. 14 is a diagram illustrating an example of a horizontal front porch (HFP) control operation.

FIG. 14 illustrates an example of the HFP control operation.

Referring to FIG. 14, when a predetermined period of time elapses after each of the internal vertical synchronization signals 1410 to 1427, calculation completion signals 1420 to 1427 may be generated to inform that the parameters are completely calculated in the operation S630. FIG. 14 shows the HFP adjustment amounts 1430 to 1435 calculated in the operation S630.

By the HFP control operation, the HFP adjustment amount is modified based on the calculated HFP adjustment amount to thereby obtain the modified HFP adjustment amounts 1440 to 1446, and the modified HFP adjustment amounts 1440 to 1446 are added to the original HFP value (e.g., 48) to thereby obtain final HFP sizes 1450 to 1456.

When the HFP adjustment amount 1430 calculated in the example of FIG. 14 is 30, it is greater than the HFP adjustment maximum value (e.g., 8) and thus the modified HFP adjustment amount 1440 may become 8. Therefore, the HFP size 1450 may become 56 (frame frequency down) or 40 (frame frequency up) as the modified HFP adjustment amount is added to the original HFP value. When such adjustment is made, the internal vertical synchronization signal is shifted toward the external vertical synchronization signal, thereby making the HFP adjustment amount 1431 become 22. Because this HFP adjustment amount is also greater than the HFP adjustment maximum value, the modified HFP adjustment amount 1441 becomes 8 and the HFP size 1451 becomes 56 (frame frequency down) or 40 (frame frequency up). With this adjustment, the internal vertical synchronization signal is further shifted toward the external vertical synchronization signal, and thus the HFP adjustment amount 1432 becomes 14. Because this HFP adjustment amount is also greater than the HFP adjustment maximum value, the modified HFP adjustment amount 1442 becomes 8 and the HFP size 1452 becomes 56 (frame frequency down) or 40 (frame frequency up). With this adjustment, the internal vertical synchronization signal is further shifted toward the external vertical synchronization signal, and thus the HFP adjustment amount 1433 becomes 6. Because this HFP adjustment amount is greater than 1 and smaller than or equal to the HFP adjustment maximum value, the modified HFP adjustment amount 1443 is decreased by 1 to become 5 and the HFP size 1453 becomes 53 (frame frequency down) or 43 (frame frequency up).

In a section where the HFP adjustment amount is smaller than or equal to the HFP adjustment maximum value, the adjusting operation in the operation 640 and the sampling operation in the operation 620 may be separately performed. Therefore, in a section of an internal vertical synchronization signal 1413, the internal vertical synchronization signal is sifted as the HFP size 1453 is applied in the operation 640. In a section of the next internal vertical synchronization signal 1414, the sampling may be carried out without performing the adjusting operation. Therefore, the parameter calculation in the operation 630 may not be performed in this section, and thus the same HFP adjustment amount 1443 of 6 can be maintained. Further, the modified HFP adjustment amount may be 0 so as not to perform the HFP control operation in this section, and therefore the HFP size 1454 may be equal to the original HFP value. This may be to measure a time interval relatively accurately between the external synchronization signal and the internal synchronization signal.

When the internal vertical synchronization signal 1415 is generated, the sampling is completed without the HFP control operation, the parameters are calculated again, and the calculation completion signal 1425 is generated. The HFP adjustment amount 1434 in this case may be modified into 1 because the internal vertical synchronization signal is further shifted toward the external vertical synchronization signal as a result of the previous adjustment. Since this HFP adjustment amount is equal to 1, the modified HFP adjustment amount 1445 of 1 may be maintained as it is, and the HFP size 1455 may become 49 (frame frequency down) or 47 (frame frequency up).

In a section of the internal vertical synchronization signal 1416, for accurate sampling, the HFP control operation is not performed, the HFP adjustment amount 1434 is maintained as it is, the modified HFP adjustment amount 1446 becomes 0, and the HFP size 1456 has the original HFP value.

When the internal vertical synchronization signal 1417 is generated, the sampling may be completed without the HFP control operation, the parameters may be calculated again, and the calculation completion 1427 may be generated. The HFP adjustment amount 1435 in this case becomes 0 so that the HFP control operation can be no longer performed, and the HFP size 1456 may maintain the original HFP value of 48.

In the operation S1330, the fine-tuning control operation may be performed to increase or decrease a specific horizontal section by 1. As shown in FIG. 2, one horizontal section may be identified as HBP+PX+HFP, and such an added value may be referred to as the horizontal-section end point value H End Point Value. The specific horizontal section may be increased or decreased by 1 based on the adjustment direction information of the internal synchronization signal. When the small value selected in FIG. 9 is the first sampling value, the internal synchronization signal needs to be delayed to synchronize with the external synchronization signal. When the selected small value is the second sampling value, the internal synchronization signal needs to be advanced to synchronize with the external synchronization signal. Therefore, when the sampling value is the first sampling value, the horizontal-section end point value may be increased by 1. When the sampling value is the second sampling value, the horizontal-section end point value may be decreased by 1. Increasing or decreasing the horizontal-section end point value by 1 may mean increasing or decreasing the HFP value by 1 in the corresponding horizontal section. Therefore, while the HFP control is to modify the HFP in the whole horizontal section, the fine-tuning control is to increase or decrease the HFP by 1 in a specific horizontal section.

The fine-tuning control operation may use the FT adjustment amount to identify the horizontal section of which the horizontal-section end point value will be modified. In the equation 3, it is assumed that the FT adjustment amount is represented with 16 bits, but the FT adjustment amount may be represented with other bits. As the number of bits representing the FT adjustment amount is increased, finer adjustment is possible.

The fine-tuning control operation may accumulate the FT adjustment amount in every horizontal section. Further, the horizontal-section end point value of the horizontal section, in which the accumulated FT adjustment amount overflows, may be modified.

Figure 15:
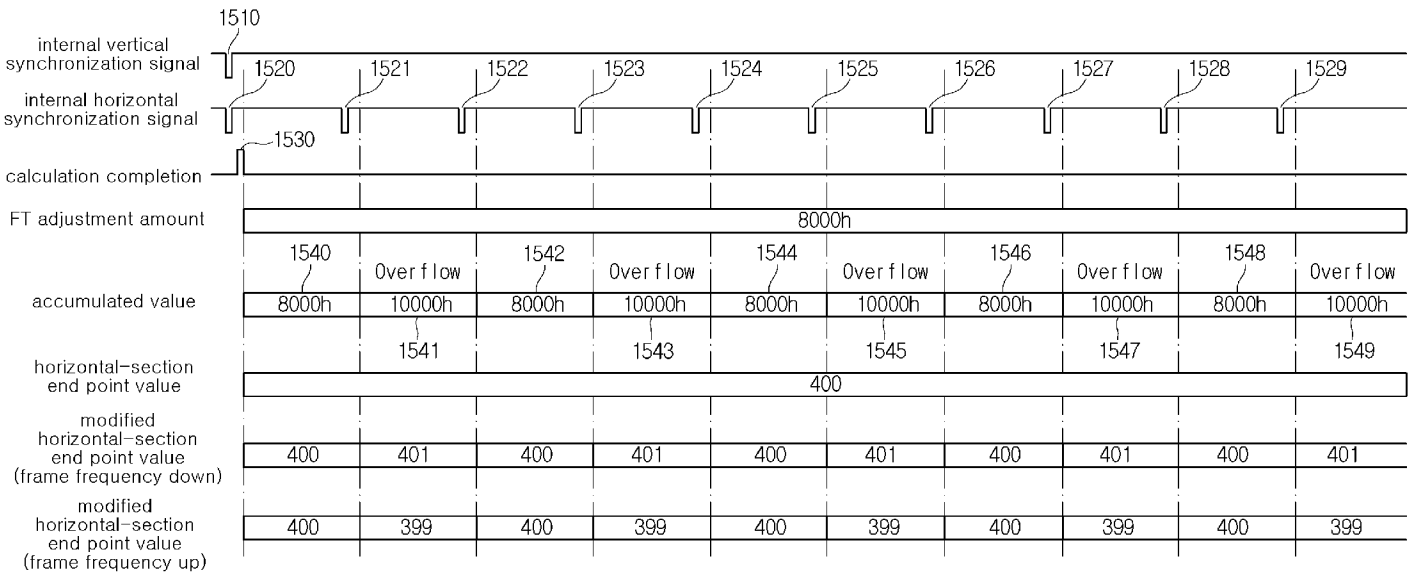
FIG. 15 is a diagram illustrating an example of a fine-tuning control operation.

FIG. 15 illustrates an example of the fine-tuning control operation.

Referring to FIG. 15, a plurality of internal horizontal synchronization signals 1520 to 1529 indicating the start of the horizontal section may be generated after an internal vertical synchronization signal 1510 indicating the start of the frame.

When the internal vertical synchronization signal 1510 is generated, the sampling in one section may be completed, and thus the generation of the parameters in the operation 630 may be completed. The completion of the parameter generation may be indicated by a calculation completion signal 1530. Referring to FIG. 15, the FT adjustment amount among the parameters generated by the operation 630 may be 8000 h. Here, 'h' may indicate a hexadecimal number.

An accumulated value may be obtained by accumulating the FT adjustment amount value on a previously accumulated value in every horizontal section 1540 to 1549. As a result of accumulation, there may be horizontal sections 1541, 1543, 1545, 1547, and 1549 in which the overflow occurs. The overflow may occur when the number of bits for representing the FT adjustment amount is 16 but a value cannot be represented by 16 bits. For example, the $17^{th}$ bit is needed to represent 8000h+8000h=10000h. Therefore, when the FT adjustment amount is represented by 16 bits, the accumulated value is represented by 17 bits, and when the $17^{th}$ bit becomes 1, it may be identified that the overflow occurs. When the overflow occurs, the $17^{th}$ bit may be reset to 0 again. As another method of identifying the overflow, it is identified that the overflow occurs when a carry is generated as the FT adjustment amount of 16 bits is added to the accumulated value of 16 bits. In other words, the overflow occurs when a value is out of an expression range of a 16 bit accumulation adder, which means that the accumulated value is greater than or equal to 2^16. In the horizontal sections in which the overflow occurs, the horizontal-section end point value is increased by 1 in a frame-frequency down case where the internal synchronization signal needs to be delayed, but decreased by 1 in the case of frame-frequency up where the internal synchronization signal needs to be advanced. In an example shown in FIG. 15, with regard to the horizontal sections 1541, 1543, 1545, 1547, and 1549 in which the overflow occurs, the horizontal-section end point value is changed into 401 in the frame-frequency down case, and changed into 399 in the case of frame-frequency up case.

With the foregoing operations, the mode transition device synchronizes the internal synchronization signal used in the command mode with the external synchronization signal used in the video mode within a preset target range (e.g., a target difference in the number of internal clocks). Then, in the operation S650, the mode transition device may switch over from the command mode to the video mode when the difference in the number of clocks between the internal synchronization signal and the external synchronization signal is within the preset target range.

As described above, the internal synchronization signal and the external synchronization signal are synchronized at the transition from the command mode to the video mode or at the transition from the video mode to the command mode, thereby preventing a flicker that may occur at the mode transition.

Figure 16:
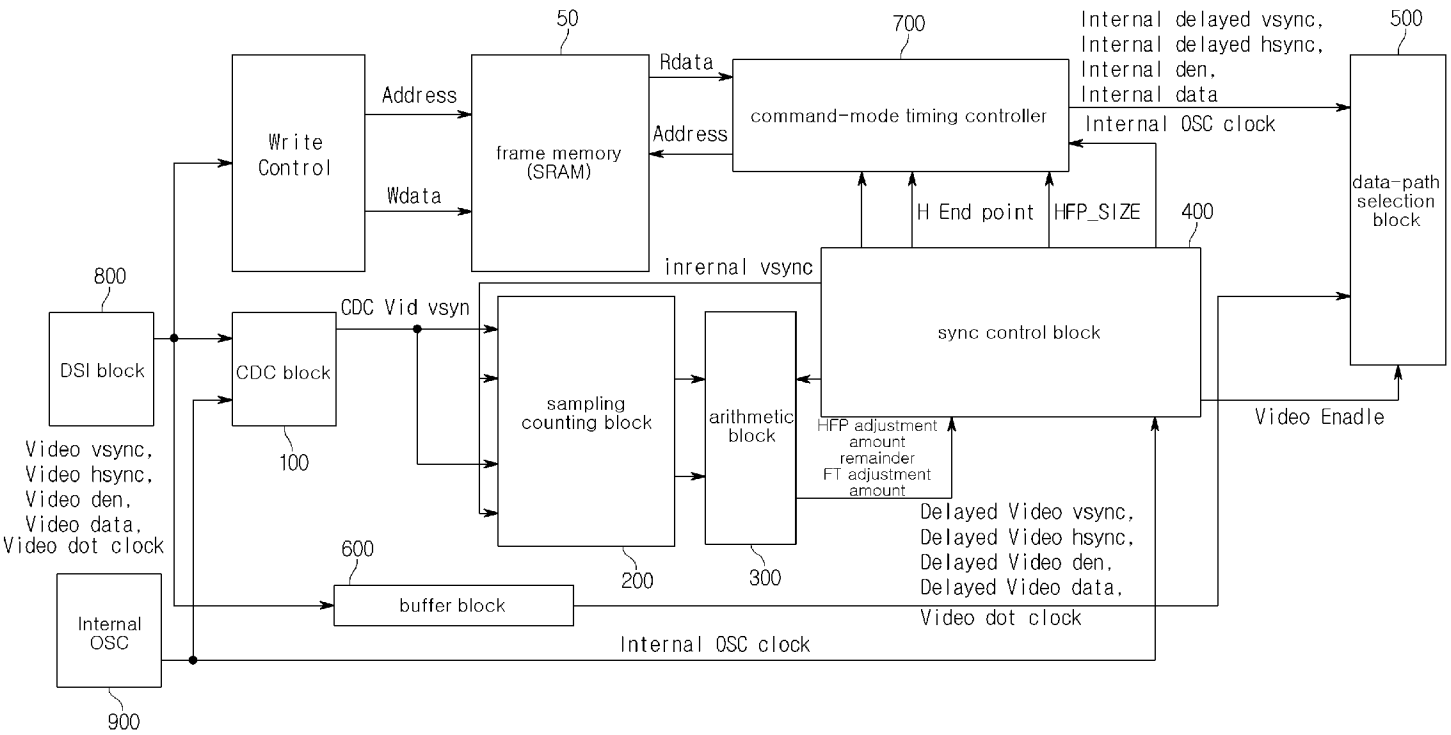
FIG. 16 is a diagram illustrating an overall configuration of the mode transition device for a seamless transition between the video mode and the command mode according to the present disclosure.

FIG. 16 illustrates an overall configuration of the mode transition device seamless transition between the video mode and the command mode according to the present disclosure.

Referring to FIG. 16, the mode transition device may include a clock domain crossing (CDC) block 100, a sampling counting block 200, an arithmetic block 300, a sync control block 400, a data-path selection block 500, a buffer block 600, a command-mode timing controller 700, and a display serial interface (DSI) block 800.

For easy understanding, FIG. 16 also illustrates the frame memory 50 in addition to the mode transition device.

The DSI refers to standards stipulated by the mobile industry processor interface (MIPI) association, which defines serial buses and communication protocols between a host of providing video data and a destination device of the video data.

The DSI block 800 may be connected to the host through the DSI, and configured to receive video data to be displayed on the pixels 10 and a control signal from the host. In the example shown in FIG. 16, the DSI is used to have access to the host, but not limited thereto. Alternatively, other communication protocols and interfaces may be used to have access to the host.

The buffer block 600 may perform a CDC processing and sampling operation for the external synchronization signal received from the host in the video mode, and an operation for delaying a signal received through the DSI block 800 as much as the time needed for the transition from the command mode to the video mode. According to an aspect, the buffer block 600 may include a first-in first-out (FIFO) or a shift register.

The CDC block 100 may be configured to latch the external synchronization signal received from the host to the internal oscillator to thereby synchronize the external synchronization signal with an internal clock domain. Thus, the synchronization controller 4000 may be configured to operate in sync with one internal clock and prevent malfunction due to asynchronization.

The data-path selection block 500 may be configured to output the data and the synchronization signal generated by the command-mode timing controller 700 or received from the buffer block 600 according to the set modes. The data-path selection block 500 may select the path based on a signal (video enable) received from the sync control block 400 (to be described later).

The sampling counting block 200 may measure a time interval between a point in time of an external synchronization signal subjected to the CDC process (hereinafter, referred to as an 'external synchronization signal') and a point in time of an internal synchronization signal, based on the number of clocks in the internal oscillator 900.

Figure 17:
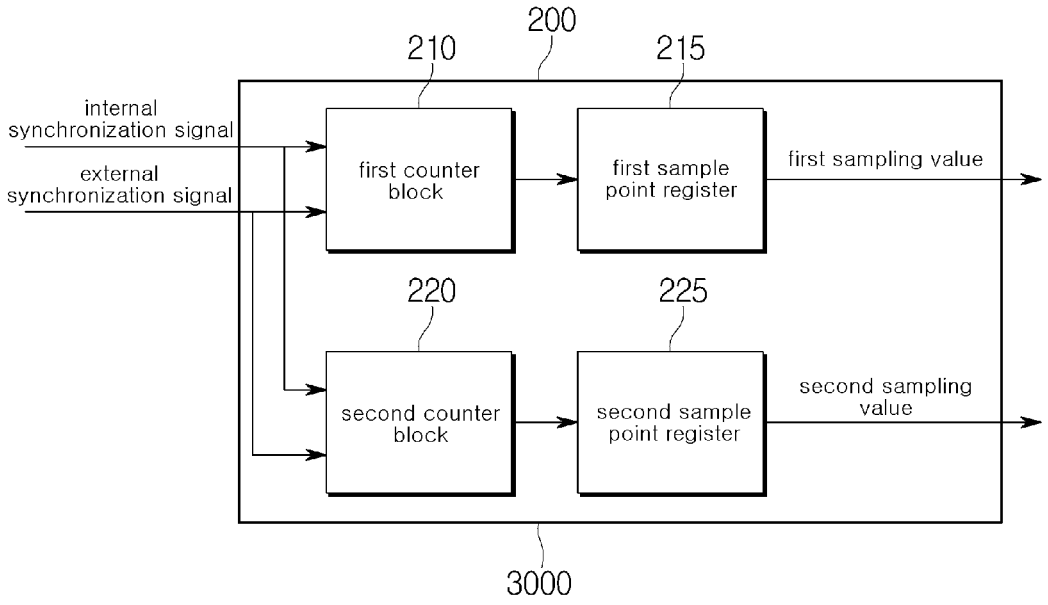
FIG. 17 is a diagram illustrating a detailed configuration of a sampling counting block 200 according to the present disclosure.

FIG. 17 illustrates a detailed configuration of a sampling counting block 200 according to the present disclosure.

Referring to FIG. 17, the sampling counting block 200 may include a first counter block 210, a second counter block 220, a first sample point register 215, and a second sample point register 225.

The first counter block 210 counts the number of clocks in the internal oscillator from the point in time of the internal synchronization signal (e.g., the internal vertical synchronization signal) to the point in time of the external synchronization signal (e.g., the external vertical synchronization signal latched by the CDC block 100). Then, the number of counted clocks may be stored in the first sample point register 215.

The second counter block 220 counts the number of clocks in the internal oscillator from the point in time of the external synchronization signal (e.g., the external vertical synchronization signal latched by the CDC block 100) to the point in time of the internal synchronization signal (e.g., the internal vertical synchronization signal). Then, the number of counted clocks may be stored in the second sample point register 225.

The operations of the sampling counting block 200 will be described with reference to the foregoing examples shown in FIGS. 10 and 11.

Referring to FIG. 10, the first counter block 210 may start counting from the internal synchronization-signal point 1031, end the counting at the external synchronization-signal point 1041, and store the first sampling value SAMPLE_POINT1, which is a counting value up to that time, in the first sample point register 215.

The second counter block 220 may start counting from the external synchronization-signal point 1041, end the counting at the internal synchronization-signal point 1033, and store the second sampling value SAMPLE_POINT2, which is a counting value up to that time, in the second sample point register 225.

Referring to FIG. 11, the first counter block 210 may start counting from the internal synchronization-signal point 1151, end the counting at the external synchronization-signal point 1161, and store the first sampling value SAMPLE_POINT1, which is a counting value up to that time, in the first sample point register 215.

The second counter block 220 may start counting from the external synchronization-signal point 1161, end the counting at the internal synchronization-signal point 1153, and store the second sampling value SAMPLE_POINT2, which is a counting value up to that time, in the second sample point register 225.

The foregoing operation of the sampling counting block 200 may be repetitively performed as shown in FIGS. 10 and 11.

The difference between FIG. 10 and FIG. 11 is based on the difference between the first sampling value and the second sampling value. FIG. 10 shows a case that the second sampling value is small, and FIG. 11 shows a case that the first sampling value is small. To reduce time taken in performing the whole operation, a smaller sampling value may be used in synchronizing the external synchronization signal and the internal synchronization signal. Therefore, the sampling counting block 200 may select the second sampling value to be transmitted to the arithmetic block 300 in the case of FIG. 10, and may select the first sampling value to be transmitted to the arithmetic block 300 in the case of FIG. 11.

The sampling value calculated in the sampling counting block 200 may be the number of internal oscillator clocks needed for shifting the point in time of the internal synchronization signal to the point in time of the external synchronization signal in order to synchronize the internal synchronization signal with the external synchronization signal.

The arithmetic block 300 may be configured to calculate and output information about a sampling value for identifying the control method in the sync control block 400 (to be described later), a quotient, which is obtained by dividing the sampling value by a total number of lines, etc.

The arithmetic block 300 may be configured to receive the sampling value from the sampling counting block 200, and obtain the HFP adjustment amount and the FT adjustment amount to be used in the HFP control method and/or the fine-tuning control method based on the received sampling value.

As described above, the HFP control method is to change an HFP value, which indicates a standby time after outputting the horizontal section so as to be applied to all the horizontal sections H included in one frame, i.e., included in between two adjacent vertical synchronization signals Vsync, thereby shifting the internal synchronization-signal point.

The fine-tuning control method refers to a method of shifting the internal synchronization-signal point by finely tuning the horizontal section end point H End Point with regard to only a specific horizontal section.

The arithmetic block 300 is configured to obtain the HFP adjustment amount, which needs to be adjusted for the HFP control with regard to one horizontal section 1H, by dividing the selected sampling value by the total number of horizontal sections, like on the foregoing equation 1.

Further, the remainder, which is the basis for performing the fine-tuning control, and the FT adjustment amount, which is required for performing the fine-tuning control, may be calculated based on the foregoing equations 2 and 3. In this calculation, it is assumed that the FT adjustment amount has a bit-width of 16 bits.

The sync control block 400 may be configured to control the synchronization between the internal synchronization signal and the external synchronization signal based on an output value of the arithmetic block 300.

Figure 18:
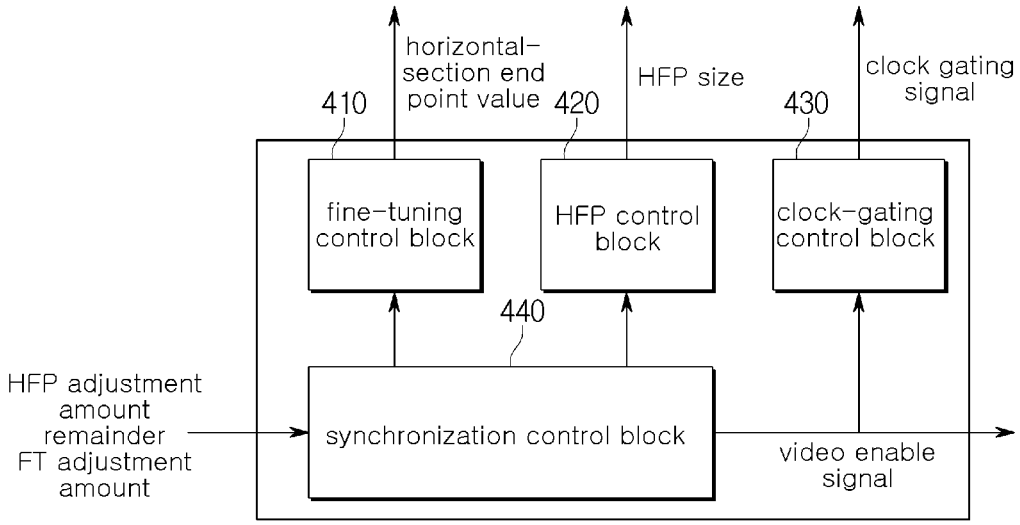
FIG. 18 is a diagram illustrating a configuration of a sync control block 400 according to the present disclosure.

FIG. 18 illustrates a configuration of the sync control block 400 according to the present disclosure.

Referring to FIG. 18, the sync control block 400 may include a fine-tuning control block 410, an HFP control block 420, a clock-gating control block 430, and a synchronization control block 440.

The HFP control block 420 may be configured to perform HFP control based on the operation S1320 of FIG. 13. To shift the internal synchronization signal, the HFP control block 420 may be configured to identify the HFP size to be applied to all the horizontal sections in each frame section as shown in FIG. 14, and provide the identified HFP size to the command-mode timing controller 700.

The fine-tuning control block 410 may be configured to perform fine-tuning control based on the operation S1330 of FIG. 13. To finely shift the internal synchronization signal, the fine-tuning control block 410 may be configured to control the internal synchronization signal to be finely shifted by increasing or decreasing an end point value in a specific horizontal section by 1 as shown in FIG. 15 and providing the increased or decreased end point value to the command-mode timing controller 700.

The clock-gating control block 430 may be configured to reduce power consumption by gating clocks related to the video mode and clocks related to the command mode based on the control of the synchronization control block 440.

The synchronization control block 440 may be configured to provide signals for operating the HFP control block 420 and the fine-tuning control block 410. The HFP control block 420 and the fine-tuning control block 410 may start and end operating based on the operation control signals received from the synchronization control block 440 and the parameters.

The synchronization control block 440 may be configured to control the transition from the command mode to the video mode when the internal synchronization signal is shifted to fall within the target range in which it can be identified that the internal synchronization signal synchronizes with the external synchronization signal.

To identify whether the internal synchronization signal falls within the target range, the synchronization control block 440 may use the sampling value or the HFP adjustment amount and the remainder value, which indicate the time interval between the external synchronization signal and the internal synchronization signal.

The synchronization control block 440 may be configured to control the current operating mode of the display device. The synchronization control block 440 may identify whether the display device operates in the command mode or the video mode.

Further, the synchronization control block 440 may be configured to provide control information to the data-path selection block 500 and the clock-gating control block 430 based on the current mode in which the display device operates.

According to an aspect, the synchronization control block 440 may be configured to provide a control signal for allowing the data-path selection block 500 to output a signal received from the command-mode timing controller 700 and a control signal for allowing the clock-gating control block 430 to gate the clocks related to the video mode when the current mode of the display device is the command mode.

According to another aspect, the synchronization control block 440 may be configured to provide a control signal for allowing the data-path selection block 500 to output a signal received from the buffer block 600 and a control signal for allowing the clock-gating control block 430 to gate the clocks related to the command mode when the current mode of the display device is the video mode. Thus, it is possible to reduce power consumption by gating the internal oscillator clocks input to the frame memory 50, the command-mode timing controller 700, the CDC block 100, the sampling counting block 200, the arithmetic block 300, the fine-tuning control block 410 and the HFP control block 420.

To perform the foregoing operations, the synchronization control block 440 may operate a finite-state machine. The finite-state machine operated by the synchronization control block 440 may have states as shown in the following table 1.

TABLE 1

| States | Description of States |
|---|---|
| IDLE STATE | Command mode |
| SAMPLING INIT | Sampling standby state |
| SAMPLING POINT1 | Storing of sampling point 1 |
| SAMPLING POINT2 | Storing of sampling point 2 |
| ADJUSTMENT CALC | calculating of parameters |
| HFP CONTROL | Performing of HFP control |
| FINE TUNING | Performing of FT control |
| BOTH CONTROL | Performing of both HFP and FT controls |
| DONE | Video mode |

Figure 19:
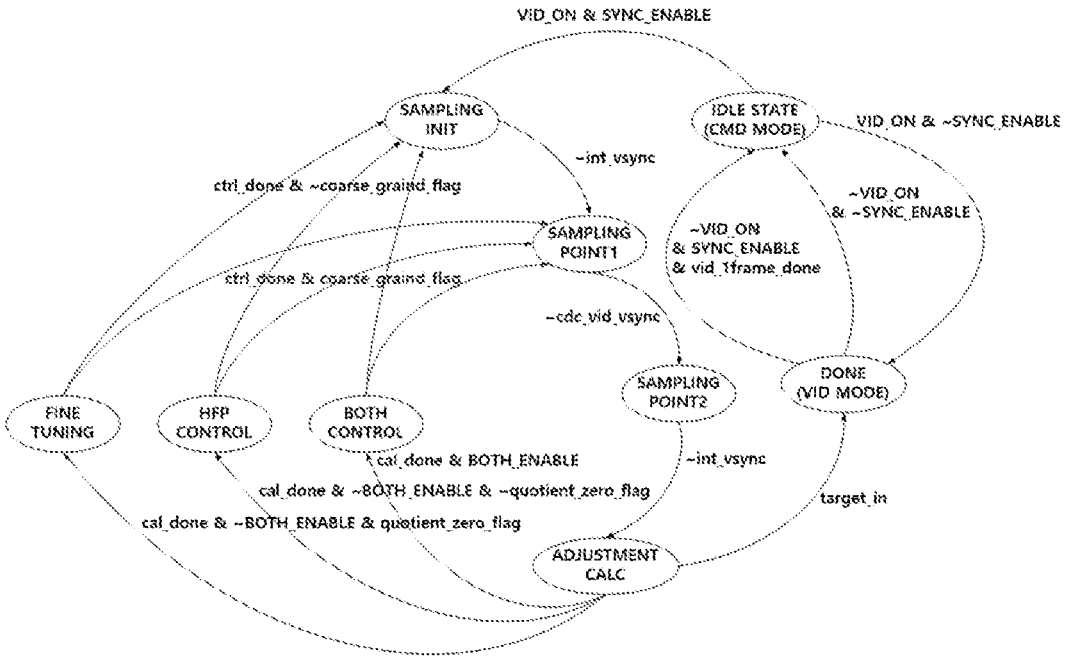
FIG. 19 is a state transition diagram of a finite-state machine of a synchronization control block 440 according to the present disclosure.

FIG. 19 is a state transition diagram of the finite-state machine of the synchronization control block 440 according to the present disclosure.

Referring to FIG. 19, 'DONE' may indicate a state that the display device is operating in the video mode. In the 'DONE', the synchronization control block 440 may provide a control signal for allowing the data-path selection block 500 to output a signal received from the buffer block 600, and a control signal for allowing the clock-gating control block 430 to gate the clocks related to the command mode.

When a signal for switching over to the command mode is received in the 'DONE' (VID_ON=0), the synchronization control block 440 may enter 'IDLE STATE'. In this case, the synchronization control block 440 enters the 'IDLE STATE' after performing the synchronization as shown in FIG. 4 when the parameters are set to synchronize the external synchronization signal with the internal synchronization signal (SYNC_ENABLE=1), or directly enters the 'IDLE STATE' when the synchronization is not required (SYNC_ENABLE=0).

The 'IDLE STATE' may indicate a state that the display device is operating in the command mode. In the 'IDLE STATE', the synchronization control block 440 may provide a control signal for allowing the data-path selection block 500 to output a signal received from the command-mode timing controller 700, and a control signal for allowing the clock-gating control block 430 to gate the clocks related to the video mode.

When a signal for switching over to the video mode is received in the 'IDLE STATE' (VID_ON=1) but the synchronization is not required (SYNC_ENABLE=0), the synchronization control block 440 may directly enter the 'DONE.' When the parameters are set to synchronize the external synchronization signal with the internal synchronization signal (SYNC_ENABLE=1), the synchronization control block 440 may enter 'SAMPLING INIT' and then enter the 'DONE' after synchronizing the internal synchronization signal with the external synchronization signal as shown in FIG. 6.

When the signal for switching over to the video mode is received in the 'IDLE STATE' (VID_ON=1) and the parameters are set to perform the synchronization (SYNC_ENABLE=1), the synchronization control block 440 may enter the 'SAMPLING INIT.'

The 'SAMPLING INIT' indicates a sampling standby state, and the sampling counting block 200 in this state may be ready to start sampling in response to the internal synchronization signal. When the internal synchronization signal is generated in the 'SAMPLING INIT' (int_vsync=0), the synchronization control block 440 may enter 'SAMPLING POINT1.'

In the 'SAMPLING POINT1' the sampling counting block 200 may perform sampling to obtain the first sampling value, obtain the first sampling value subjected to the sampling when the external synchronization signal is received, and perform sampling to obtain the second sampling value. Therefore, when the external synchronization signal is received in the 'SAMPLING POINT1' (cdc_vid_vsync=0), the synchronization control block 440 may make the finite-state machine enter 'SAMPLING POINT2.'

The 'SAMPLING POINT2' may indicate a state that the sampling counting block 200 performs sampling for the second sampling value. When the internal synchronization signal is received in the 'SAMPLING POINT2' (int_vsync=0), the synchronization control block 440 may identify that the sampling for the second sampling value is completed in the sampling counting block 200, and make the finite-state machine enter 'ADJUSTMENT CALC.'

In the 'ADJUSTMENT CALC,' the synchronization control block 440 may identify whether the internal synchronization signal falls within the target range to synchronize with the external synchronization signal. When it is identified that the internal synchronization signal synchronizes with the external synchronization signal (target_in), the synchronization control block 440 may make the finite-state machine enter the 'DONE' which indicates the state that the display device is operating in the video mode.

When the internal synchronization signal is not synchronized with the external synchronization signal in the 'ADJUSTMENT CALC', the synchronization control block 440 may enter 'FINE TUNING' for performing the fine-tuning control, 'HFP CONTROL' for performing the HFP control, or 'BOTH CONTROL' for performing both the fine-tuning control and the HFP control after the parameters needed for the HFP control and the fine-tuning control are completely calculated (cal_done=1), based on the parameters for the parameter indicating whether to perform both the HFP control and the fine-tuning control (BOTH_ENABLE=1), etc.

In the corresponding states, the synchronization control block 440 may enter the 'SAMPLING INIT' or 'SAMPLING POINT1' based on the calculated parameter of the HFP adjustment amount value. According to an aspect, when the calculated HFP adjustment amount is greater than the HFP adjustment maximum value HFP_LIMIT, the synchronization control block 440 may enter the 'SAMPLING POINT1'. In this case, for quick synchronization, the sampling may be performed while the internal synchronization signal is shifted. According to another aspect, when the calculated HFP adjustment amount is smaller than or equal to the HFP adjustment maximum value HFP_LIMIT, the synchronization control block 440 may enter the 'SAMPLING INIT.' In this case, for accurate sampling, the internal synchronization signal may be shifted separately from the sampling.

At the transition from the command mode to the video mode, the states other than the 'IDLE' and the 'DONE' may be repeated until the synchronization completion is identified in the 'ADJUSTMENT CALC.'

Although exemplary aspects of the disclosure have been described above, it will be appreciated by those skilled in the art that various modifications and changes can be made without departing from the spirit and scope of the disclosure as claimed in the following appended claims.

Based on the foregoing method, it is possible to seamlessly switch over between the modes without a flicker phenomenon at the mode transition between the command mode using the internal synchronization signal and the video mode driven by the external synchronization signal while driving the display.

What is claimed is:

1. A method of seamlessly switching over between a command mode and a video mode in driving a display, comprising:

receiving a command for switching over to the video mode from the command mode;

generating a sampling value by measuring a time interval between a transition time of an internal synchronization signal used in the command mode and a transition time of an external synchronization signal received in the video mode;

generating a parameter for shifting the internal synchronization signal based on the sampling value;

shifting the internal synchronization signal to synchronize with the external synchronization signal based on the parameter; and switching over to the video mode from the command mode when the internal synchronization signal of the command mode synchronizes with the external synchronization signal.

2. The method according to claim 1, wherein the generating the sampling value comprises:

obtaining a first sampling value which indicates a number of clocks from the point in time of the internal synchronization signal to the point in time of the external synchronization signal;

obtaining a second sampling value which indicates a number of clocks from the point in time of the external synchronization signal to the point in time of the internal synchronization signal; and selecting a smaller value between the first sampling value and the second sampling value.

3. The method according to claim 1, wherein the generating the parameter for shifting the internal synchronization signal comprises:

generating a quotient and a remainder which are obtained by dividing the sampling value by a total number of lines of a display panel;

setting the quotient as a horizontal front porch (HFP) adjustment amount; and generating a fine-tuning (FT) adjustment amount by multiplying the remainder by an adjustment parameter and dividing the production of multiplication by the total number of lines.

4. The method according to claim 3, wherein the shifting the internal synchronization signal to synchronize with the external synchronization signal based on the parameter comprises:

identifying whether the internal synchronization signal and the external synchronization signal are synchronized; and when it is identified that the internal synchronization signal and the external synchronization signal are not synchronized, performing at least one of an HFP control operation, in which the internal synchronization signal is shifted by modifying an HFP (a waiting time after outputting valid data for a horizontal section) size with regard to all the horizontal sections in one frame based on the HFP adjustment amount, and a fine-tuning control operation, in which the internal synchronization signal is shifted by tuning a horizontal-section end point value (H end point value) with regard to a horizontal section in which an overflow occurs as an accumulated value obtained by accumulating the FT adjustment amount in every horizontal section is greater than the adjustment parameter.

5. The method according to claim 4, wherein the fine-tuning control operation is performed when the remainder is not zero, and wherein the HFP control operation is performed when the HFP adjustment amount is not zero.

6. The method according to claim 4, wherein the HFP control operation comprises:

modifying the HFP adjustment amount into a preset HFP adjustment maximum value when the HFP adjustment amount is greater than the HFP adjustment maximum value;

decreasing the HFP adjustment amount by 1 when the HFP adjustment amount is greater than 1 and smaller than or equal to the HFP adjustment maximum value; and setting the HFP size as a value obtained by adding or subtracting the HFP adjustment amount to or from an original HFP value.

7. The method according to claim 6, wherein the setting the HFP size as the value obtained by adding or subtracting the HFP adjustment amount to or from the original HFP value comprises:

setting the HFP size as the value obtained by adding the HFP adjustment amount to the original HFP value when the first sampling value is selected as the sampling value; and setting the HFP size as the value obtained by subtracting the HFP adjustment amount from the original HFP value when the second sampling value is selected as the sampling value.

8. The method according to claim 4, wherein the fine-tuning control operation comprises:

increasing the horizontal-section end point value by 1 when the first sampling value is selected as the sampling value; and decreasing the horizontal-section end point value by 1 when the second sampling value is selected as the sampling value.

9. The method according to claim 1, further comprising:

receiving a command for switching over to the command mode from the video mode; and switching over to the command mode from the video mode at a point in time when transmission of a current video frame is completed, without immediately switching over to the command mode as soon as the switching command is generated.

10. A device for seamlessly switching over between a command mode and a video mode, comprising:

a display serial interface (DSI) block configured to receive video data and a control signal including an external synchronization signal;

a buffer block configured to delay the video data and the control signal received through the DSI block;

a command-mode timing controller configured to generate an internal synchronization signal and load data from a frame memory based on the internal synchronization signal;

a sampling counting block configured to generate a sampling value by measuring a time interval between a transition time of an external synchronization signal and a transition time of an internal synchronization signal;

an arithmetic block configured to generate a parameter for shifting the internal synchronization signal based on the sampling value;

a sync control block configured to identify whether the internal synchronization signal and the external synchronization signal are synchronized, based on the parameter, control the internal synchronization signal to be shifted when it is identified that the internal synchronization signal and the external synchronization signal are not synchronized, and switch over between the video mode and the command mode when it is identified that the internal synchronization signal and the external synchronization signal are synchronized; and a data-path selection block configured to output video data and a command-mode control signal received from the command-mode timing controller or output video data and a video-mode control signal received from the buffer block, based on a mode selection signal received from the sync control block.

11. The device according to claim 10, further comprising a clock domain crossing (CDC) block configured to synchronize with an internal clock domain by latching the external synchronization signal with an internal oscillator clock.

12. The device according to claim 10, wherein the sampling counting block comprises:

a first counter block configured to measure a first sampling value which indicates a number of clocks from the point in time of the internal synchronization signal to the point in time of the external synchronization signal;

a second counter block configured to measure a second sampling value which indicates a number of clocks from the point in time of the external synchronization signal to the point in time of the internal synchronization signal; and a first sample point register configured to store the first sampling value; and a second sample point register configured to store the second sampling value, wherein a smaller value between the first sampling value and the second sampling value is selected as a sampling value.

13. The device according to claim 10, wherein the arithmetic block is further configured to:

obtain a quotient and a remainder which are obtained by dividing a sampling value output from a sampling counting block by a total number of lines of a display panel;

set the quotient as a horizontal front porch (HFP) adjustment amount;

generate a fine-tuning (FT) adjustment amount by multiplying the remainder by an adjustment parameter and dividing a product of multiplication by the total number of lines; and output the HFP adjustment amount, the remainder, and the FT adjustment amount as parameters.

14. The device according to claim 13, wherein the sync control block comprises:

an HFP control block configured to control the internal synchronization signal to be shifted by modifying an HFP (a waiting time after outputting valid data for a horizontal section) size with regard to all the horizontal sections in one frame based on the HFP adjustment amount;

a fine-tuning control block configured to control the internal synchronization signal to be shifted by tuning a horizontal-section end point value (H end point value) with regard to a horizontal section in which an overflow occurs as an accumulated value obtained by accumulating the FT adjustment amount in every horizontal section is greater than the adjustment parameter, and a synchronization control block configured to identify whether the internal synchronization signal and the external synchronization signal are synchronized, switch over between the command mode and the video mode when it is identified that the internal synchronization signal and the external synchronization signal are synchronized, and control the HFP control block and the fine-tuning control block to operate when the internal synchronization signal and the external synchronization signal are not synchronized.

15. The device according to claim 14, wherein the HFP control block is configured to:

modify the HFP adjustment amount into a preset HFP adjustment maximum value when the HFP adjustment amount is greater than the HFP adjustment maximum value;

decrease the HFP adjustment amount by 1 when the HFP adjustment amount is greater than 1 and smaller than or equal to the HFP adjustment maximum value;

set the HFP size by adding or subtracting the HFP adjustment amount to or from an original HFP value; and transmit the set HFP size to the command-mode timing controller, and the command-mode timing controller is configured to generate the internal synchronization signal based on the HFP size.

16. The device according to claim 15, wherein the HFP control block is configured to:

set the HFP size by adding the HFP adjustment amount to an original HFP value to control a point in time of generating the internal synchronization signal to be delayed when the first sampling value is smaller than the second sampling value; and set the HFP size by subtracting the HFP adjustment amount from the original HFP value to control the point in time of generating the internal synchronization signal to be advanced when the second sampling value is smaller than the first sampling value.

17. The device according to claim 14, wherein the fine-tuning control block is configured to:

increase the horizontal-section end point value by 1 with regard to the horizontal section where the overflow occurs, when the first sampling value is smaller than the second sampling value;

decrease the horizontal-section end point value by 1 with regard to the horizontal section where the overflow occurs, when the second sampling value is smaller than the first sampling value; and transmit the horizontal-section end point value to the command-mode timing controller, wherein the command-mode timing controller is configured to set a length of a corresponding horizontal section based on the horizontal-section end point value.

18. The device according to claim 14, wherein the sync control block is configured to:

control the fine-tuning control block not to operate when the remainder is zero; and control the HFP control block not to operate when the HFP adjustment amount is zero.

19. The device according to claim 14, wherein the synchronization control block is configured to switch over to the command mode from the video mode after receiving a signal indicating completed transmission of a current video frame, without immediately switching over to the command mode as soon as a command for switching over from the video mode to the command mode is received when the switching command is received.

20. A display device comprising:

a display panel configured to output a video;

a display serial interface (DSI) block configured to receive video data and a control signal including an external synchronization signal;

a buffer block configured to delay the video data and the control signal received through the DSI block;

a command-mode timing controller configured to generate an internal synchronization signal and load data from a frame memory based on the internal synchronization signal;

a sampling counting block configured to generate a sampling value by measuring a time interval between a transition time of an external synchronization signal and a transition time of an internal synchronization signal;

an arithmetic block configured to generate a parameter for shifting the internal synchronization signal based on the sampling value;

a sync control block configured to identify whether the internal synchronization signal and the external synchronization signal are synchronized, based on the parameter, control the internal synchronization signal to be shifted when it is identified that the internal synchronization signal and the external synchronization signal are not synchronized, and switch over between the video mode and the command mode when it is identified that the internal synchronization signal and the external synchronization signal are synchronized;

a data-path selection block configured to output the video data and a command-mode control signal received from the command-mode timing controller or output video data and a video-mode control signal received from the buffer block, based on a mode selection signal received from the sync control block;

a timing controller configured to obtain the video data and the control signal from the mode switching device, and generate input data, a source control signal, and a gate control signal;

a source drive circuit configured to generate video signals to be displayed on the display panel based on the input data and the source control signal; and a gate drive circuit configured to output a plurality of gate signals in sequence to control the display panel based on the gate control signal.

* * * * *